US011214288B2

(12) United States Patent
Ghaly

(10) Patent No.: US 11,214,288 B2
(45) **Date of Patent: *Jan. 4, 2022**

(54) METHOD AND APPARATUS FOR A TRAIN CONTROL SYSTEM

(71) Applicant: Nabil N. Ghaly, Huntington Station, NY (US)

(72) Inventor: Nabil N. Ghaly, Huntington Station, NY (US)

( * ) Notice: Subject to any disclaimer, the term of this patent is extended or adjusted under 35 U.S.C. 154(b) by 420 days.

This patent is subject to a terminal disclaimer.

(21) Appl. No.: 16/350,896

(22) Filed: Jan. 30, 2019

(65) Prior Publication Data

US 2019/0168788 A1 Jun. 6, 2019

Related U.S. Application Data

(63) Continuation of application No. 15/731,443, filed on Jun. 10, 2017, now Pat. No. 10,232,866, which is a continuation of application No. 14/544,708, filed on Feb. 7, 2015, now Pat. No. 9,718,487.

(60) Provisional application No. 61/966,196, filed on Feb. 18, 2014.

(51) Int. Cl.

| | |
|---|---|
| ***B61L 27/00*** | (2006.01) |
| ***B61L 15/00*** | (2006.01) |
| ***B61L 27/04*** | (2006.01) |
| ***B61L 27/02*** | (2006.01) |

(52) U.S. Cl.

CPC ..... *B61L 27/0005* (2013.01); *B61L 15/0018* (2013.01); *B61L 15/0063* (2013.01); *B61L 27/0038* (2013.01); *B61L 27/0055* (2013.01); *B61L 27/04* (2013.01); *B61L 15/0027* (2013.01); *B61L 27/02* (2013.01); *B61L 2027/005* (2013.01); *B61L 2205/04* (2013.01)

(58) Field of Classification Search

CPC ..... B61L 27/0005; B61L 27/0038; B61L 15/0018; B61L 15/0063; B61L 27/04; B61L 27/0055; B61L 15/0027; B61L 27/02; B61L 2205/04

See application file for complete search history.

(56) References Cited

U.S. PATENT DOCUMENTS

| | | | | |
|---|---|---|---|---|
| 5,398,894 A * | 3/1995 | Pascoe | B61L 21/10 246/28 R |
| 7,539,624 B2 * | 5/2009 | Matheson | B61L 27/0016 705/7.22 |
| 8,972,484 B2 * | 3/2015 | Naphade | G06N 20/00 709/203 |

(Continued)

*Primary Examiner* — Russell Frejd

(57) ABSTRACT

A method and an apparatus for a train control system are disclosed, and are based on virtualization of train control logic and the use of cloud computing resources. A train control system is configured into two main parts. The first part includes physical elements of the train control system, and the second part includes a virtual train control system that provides the computing resources for the required train control application platforms. The disclosed architecture can be used with various train control technologies, including communications based train control, cab-signaling and fixed block, wayside signal technology. Further, the disclosure describes methodologies to convert cab-signaling and manual operations into distance to go operation.

26 Claims, 26 Drawing Sheets

(56) References Cited

U.S. PATENT DOCUMENTS

| | | | | |
|---|---|---|---|---|
| 2009/0143928 | A1* | 6/2009 | Ghaly | B61L 19/06 701/19 |
| 2009/0230254 | A1* | 9/2009 | Daum | B61L 3/125 246/27 |
| 2012/0310707 | A1* | 12/2012 | Naphade | G06F 16/29 705/7.31 |
| 2014/0012439 | A1* | 1/2014 | Dimmer | B61L 25/025 701/19 |
| 2014/0166820 | A1* | 6/2014 | Hilleary | B61L 29/246 246/125 |

* cited by examiner

METHOD AND APPARATUS FOR A TRAIN CONTROL SYSTEM

PARENT CASE TEXT

This is a continuation application of patent application U.S. Ser. No. 15/731,443, filed in the Patent Office on Jun. 10, 2017, now issued as U.S. Pat. No. 10,232,866, which is a continuation application of patent application U.S. Ser. No. 14/544,708, filed in the Patent Office on Feb. 7, 2015, now issued as U.S. Pat. No. 9,718,487, which benefits from provisional application of U.S. Ser. No. 61/966,196 filed on Feb. 18, 2014.

BACKGROUND OF THE INVENTION

Field of the Invention

This invention relates generally to train control systems, and more specifically to a train control system that is based on a generic new architecture that can be customized to the functional, operational, and safety requirements, as well as the operational environments of various railroad and transit properties. This generic architecture also provides a structured approach to achieve interoperability between different suppliers that employ different technologies or different design solutions to implement train control systems. The architecture can also be used to provide interoperability between two railroad operations that share common track.

Since the invention of the track circuit by William Robinson in 1872, train control systems have evolved from the early fixed block, wayside technologies, to various fixed block, cab-signaling technologies, and in recent years to communications based train control (CBTC), A.K.A. moving block technologies. In a CBTC system a train receives a movement authority from a wayside device, and generates a stopping profile that governs its movement from its current position to the limit of the movement authority. There are a number of possible variations of these basic technologies, and which operate by converting either a wayside signal aspect or a cab signaling speed code into a corresponding movement authority limit.

A train control system normally includes three main elements. The first element provides interlocking control and safety functions that enable trains to operate safely in the approach to, and over track switches (interlockings). Typically, the interlocking control element provides safety functions, including switch locking function when a train is operating in the approach to, or over a switch; route locking functions to protect against conflicting and opposing train moves at an interlocking; and traffic locking functions to protect against opposing moves between interlockings.

The second element provides a number of safety functions related to train movements. These functions include: train detection, safe train separation, and over-speed protection. The third element, known as Automatic Train Supervision (ATS), is normally non-vital, or non-safety critical, and provides service delivery functions, including centralized traffic control, automatic routing, automatic dispatching, schedule adherence and train regulation. The level of integration between these three elements of a train control system is a design choice. For example, a highly integrated CBTC system provides both train control and interlocking functions in a single element, and has a subsystem that provides the ATS functions.

One factor or characteristic that is common to these basic technologies is that the various physical elements of a train control system are installed in a railroad operating environment, and interact directly with each other. For example, a train detection, or location determination subsystem interacts with an interlocking controller for the purpose of implementing a switch locking function. However, the actual implementation of a specific train control function can vary greatly from railroad to railroad, as well as from supplier to supplier depending on the technology employed, and the specific design choice used. Another example is the interaction between wayside zone controller and a car borne controller in a CBTC system. Normally, a train sends its location to the zone controller, and in turn, the zone controller sends a movement authority limit to the train. This interchange of data between two physical components of the CBTC system, installed in a railroad operating environment, makes it challenging and to a certain extent difficult to achieve interoperability between different suppliers. In addition, train control implementation on a specific railway or transit property requires customization of the supplier's system, or technical platform, in order to meet the specific functional, operating and performance requirements of the railway or transit property.

Accordingly, there is a need for a new approach to streamline the customization of a supplier's train control system to the specific requirements of a rail property, as well as to facilitate interoperability between suppliers and railroads using shared tracks.

Description of Prior Art

In a fixed block wayside signal system, the tracks are divided into a plurality of blocks, wherein each block includes a train detection device such as a track circuit or axle counters to detect the presence of a train within the block. Vital logic modules employ train detection information to activate various aspects at a plurality of wayside signals in order to provide safe train separation between trains. An automatic train stop is normally located at each wayside signal location to enforce a stop aspect.

Cab-signaling technology is well known, and has evolved from fixed block, wayside signaling. Typically, a cab-signal system includes wayside elements that generate discrete speed commands based on a number of factors that include train detection data, civil speed limits, train characteristics, and track geometry data. The speed commands are injected into the running rails of the various cab-signaling blocks, and are received by trains operating on these blocks via pickup coils. A cab-signal system also includes car-borne devices that present the speed information to train operators, and which ensure that the actual speed of a train does not exceed the safe speed limit received from the wayside.

CBTC technology is also known in the art, and has been gaining popularity as the technology of choice for new transit properties. A CBTC system is based on continuous two-way communications between intelligent trains and Zone controllers on the wayside. An intelligent train determines its own location, and generates and enforces a safe speed profile. There are a number of structures known in the art for a train to determine its own location independent of track circuits. One such structure uscs a plurality of passive transponders that are located on the track between the rails to provide reference locations to approaching trains. Using a speed measurement system, such as a tachometer, the vital onboard computer continuously calculates the location and speed of the train between transponders.

The operation of CBTC is based on the moving block principle, which requires trains in an area to continuously report their locations to a Zone Controller. In turn, the Zone Controller transmits to all trains in the area a data map that contains the topography of the tracks (i.e., grades, curves, super-elevation, etc.), the civil speed limits, and the locations of wayside signal equipment. The Zone controller, also, tracks all trains in its area, calculates and transmits to each train a movement authority limit. A movement authority is normally limited by a train ahead, a wayside signal displaying a stop indication, a failed track circuit, an end of track, or the like. Upon receiving a movement authority limit, the onboard computer generates a speed profile (speed vs. distance curve) that takes into account the limit of the movement authority, the civil speed limits, the topography of the track, and the braking characteristics of the train. The onboard computer, also, ensures that the actual speed of the train does not exceed the safe speed limit.

In addition to the above three basic technologies, there are a number of hybrid systems that combine certain structures of the basic technologies. For example, a Hybrid CBTC system employs traditional wayside fixed blocks with associated cab-signal control devices, as well as intelligent CBTC car borne equipment. The cab-signal control devices generate discrete speed commands that are injected into the running rails of the various cab-signaling blocks. In turn, an intelligent CBTC car borne device determines the location of the associated train, and generates a movement authority limit (MAL) based on the speed commands received from the wayside cab-signaling devices.

The current invention, provides a generic virtual train control system that is based on concepts employed in the prior art, as well as new concepts disclosed in this invention. The elements of a physical or real train control system are indirectly interconnected to virtual train control application platforms through corresponding elements in the generic virtual system. This approach eliminates the need for direct interactions between the physical elements of a train control system and the train control application platform. The introduction of a generic virtual system simplifies the implementation of a train control system, and facilitates interoperability between suppliers. In the proposed architecture, the focus of interoperability is on the interfaces are between physical elements and corresponding virtual elements, rather than on the interfaces between the physical elements and the train control application platforms.

OBJECT OF THE INVENTION

This invention relates to train control systems, and in particular to train control systems that employ generic virtual systems, wherein elements of a virtual system are implemented in a cloud computing environment, are depicted as virtual train control elements, and act as interfaces to corresponding physical elements in the real train control installation. Accordingly, it is an object of the current invention to provide a method to associate real trains operating in a physical train control installation with virtual trains operating in a virtual train control system.

It is another object of this invention to provide a train control system, wherein traditional physical elements in a real train control system, including track switches, wayside signals, train detection devices, automatic train stops, etc., interact with corresponding elements in a virtual train control system.

It is also an object of this invention to provide a train control system, wherein a virtual train control system is implemented in a cloud computing environment, wherein cloud computing resources are used to provide train control application platforms, and wherein elements of said virtual train control system interact with corresponding elements in the physical train control installation to provide the required train control functions.

It is still an object of this invention to provide a train control installation that employs a virtual train control system that implements the required safety rules, and wherein elements of said virtual train control system communicates with corresponding elements of the physical train control installation using pre-defined interfaces and protocols.

It is another object of the invention to provide a train control system, wherein vital train control application platforms, which provide certain safety functions, are implemented using cloud computing resources that are installed at a remote location (a supplier's facility for example), and wherein a communication network provides communication channels between physical train control elements located at a railway installation and said vital train control application platforms installed at the remote location.

It is a further object of this invention to provide a new train control installation that employs a virtual train control system, wherein said virtual train control system includes a plurality of virtual trains, wherein a physical train operating under the control of said new train control installation is assigned to a specific virtual train, wherein the virtual train transmits train control data to the physical train, including a speed code or a movement authority limit, and wherein the physical train transmits train operating and status data to the virtual train, including train position and speed.

It is another object of this invention to provide a new train control installation that employs a virtual train control system, wherein said virtual train control system includes a plurality of virtual track switches, wherein a physical track switch installed at said new train control installation is assigned to a specific virtual switch in the virtual train control system, wherein the virtual switch transmits switch control data to the physical track switch, and wherein the physical track switch transmits switch operating and status data to the virtual switch, including switch position, switch in or out of correspondence, and switch locking condition.

It is also an object of this invention to provide a new train control installation that employs a virtual train control system, wherein said virtual train control system includes a plurality of virtual signals, wherein a physical signal installed at said new train control installation is assigned to a specific virtual signal, wherein the virtual signal transmits signal control data to the physical signal, including the specific indications or aspects to be displayed at the physical signal, and wherein the physical signal transmits signal operating status data to the virtual signal, including what aspects are energized and any lights out conditions.

It is still an object of this invention to provide a new train control installation that employs a virtual train control system, wherein said virtual train control system includes a plurality of virtual train detection blocks, wherein a physical train detection block included in said new train control installation is assigned to a specific virtual train detection block in the virtual train control system, and wherein the physical train detection block transmits its operating status to the virtual train detection block.

It is also an object of this invention to provide a plurality of new train control installations, each of which is provided by a different supplier, wherein each train control installation employs a virtual train control system, and wherein a physical train interacts with a virtual train that moves from a first train control system provided by one supplier to the next train control system provided by another supplier.

It is further an object of this invention to provide a method to achieve interoperability between a plurality train control systems, each of which is installed at a different railway property, wherein each train control installation employs a virtual train control system, and wherein a physical train interacts with a virtual train that moves from a first train control system in one railway property to the next train control system in a different railway property.

It is another object of this invention to provide a new train control installation that employs a virtual train control system, wherein virtual trains operate on the virtual train control system based on an "optimum" schedule, or based on a real schedule used by the train control installation.

It is yet an object of this invention to provide a new train control installation that employs a virtual train control system, wherein traditional elements in a physical train control installation, including trains, track switches, wayside signals, train detection devices, automatic train stops, etc., interact with corresponding elements in said virtual train control system, wherein virtual trains within the virtual train control system can operate at various modes of operation, including degraded modes, and wherein the operating parameters of a physical train that is associated with a virtual train are based on the operating mode and operating parameters of the virtual train.

It is also an object of this invention to provide a new train control installation that employs a virtual train control system that uses virtual trains that have bidirectional communications with physical trains operating at the new train control installation, wherein upon a loss of communication between a physical train and its associated virtual train, the physical train is brought to a complete stop, and is operated at a restricted speed based on operating rules and procedures.

It is still an object of this invention to provide a new train control installation that employs a virtual train control system, which uses virtual trains that have bidirectional communications with physical trains operating at the new train control installation, wherein upon a loss of communication between a physical or a real train and its associated virtual train, the virtual train is brought to a complete stop, and does not move until the virtual train control system receives updated operating data about the location of the associated physical train from new train control installation elements.

It is a further object of this invention to provide a new train control installation that employs a virtual train control system, which uses virtual trains that have bidirectional communications with physical trains operating at the new train control installation, wherein upon a loss of communication between a physical train and its associated virtual train, the virtual train is brought to a complete stop, and wherein the new train control installation uses transponders and/or train detection devices to detect the movement of the physical train that lost communication with its associated virtual train.

It is another object of this invention to provide a new train control installation that employs a virtual train control system, which uses virtual track switches that have bidirectional communications with physical track switches operating at the new train control installation, wherein upon a loss of communication between a physical track switch and its associated virtual track switch, the status of the virtual track switch is set to "out of correspondence" until bidirectional communication is reestablished or until a manual override is activated based on operating rules and procedures.

It is also an object of this invention to provide a new train control installation that employs virtual trains that interact with physical train control elements of the train control installation, and wherein said virtual trains interact with physical trains via a two way communication system.

It is still an object of the current invention to provide a new train control installation that employs a virtual train control system, wherein traditional elements in a physical train control installation, including trains, track switches, wayside signals, train detection devices, automatic train stops, etc., interact with corresponding elements in said virtual train control system, and wherein an Automatic Train Supervision (ATS) subsystem interacts with the virtual train control system to control the new train control installation and manage service delivery.

It is a further object of the invention to provide a new train control installation that employs a virtual train control system, which uses virtual trains that interact with physical trains, wherein a virtual train send a movement authority limit to its corresponding physical train, and wherein the onboard train control device of the physical train generates an on-board stopping profile that reflects civil speed limits included in an onboard data base.

It is also an object of the invention to provide a new train control installation that employs a virtual train control system that is based on the moving block principle, wherein virtual trains receive train location information from corresponding physical trains, and relay this location information to a virtual zone controller implemented in the cloud computing environment, and wherein said zone controller generates and transmits a movement authority limit to the virtual train, which in turn transmits said movement authority limit to the associated physical train.

It is still an object of this invention to provide a new train control installation that employs a virtual train control system implemented in a cloud computing environment, and which is based on the cab-signaling technology, wherein virtual logic controllers receive train location information from train detection devices in the physical train control installation, and generate and transmit cab-signaling speed codes to virtual trains, which in turn transmit the speed codes to corresponding physical trains.

It is a further object of this invention to provide a new train control installation that employs a virtual train control system implemented in a cloud computing environment, and which is based on the hybrid CBTC technology, wherein virtual trains receive train location information from corresponding physical trains, wherein virtual logic controllers receive train location information from train detection devices in the physical train control installation, and generate and transmit cab-signaling speed codes to virtual trains, and wherein virtual trains calculate and transmit movement authority limits to corresponding physical trains.

It is also an object of this invention to provide an overlay on an existing train control installation, wherein said overlay employs a virtual train control system implemented in a cloud computing environment, and which includes virtual trains, and which receives train control operational data from said existing train control installation, and which generates movement authority limits to provide positive stop enforcement and enforcement of civil speed limits to virtual trains, which in turn transmit the movement authority limits to corresponding physical trains.

It is still an object of this invention to provide a new train control installation that employs a virtual train control system implemented in a cloud computing environment, and which is based on fixed block wayside technology, wherein virtual train detection blocks, virtual signals, virtual automatic train stops and virtual track switches communicate with corresponding elements in the physical train control installation, wherein a virtual signal sends control data to, and receives status data from, the corresponding physical signal, wherein a physical train detection block sends its occupancy status to the corresponding virtual detection block, wherein a virtual automatic train stop sends control data to, and receives status data from, the corresponding physical automatic train stop, wherein a virtual track switch sends control data to, and receives status data from, the corresponding physical track switch, and wherein the signal logic functions that provides safety of operation are implemented in the virtual train control system.

It is a further object of this invention to provide a train control installation that employs a virtual train control system implemented in a cloud computing environment, and which is based on fixed block wayside technology, wherein the signal control logic is implemented in a signal application platform within the virtual train control system, and wherein physical signals and associated automatic train stops receive control data from corresponding virtual elements in the virtual train control system, and wherein the statuses of train detection equipment and automatic train stops are provided by physical elements in the train control installations to corresponding virtual elements in the virtual train control system.

It is also an object of this invention to provide a method and apparatus for a train control system that is based on fixed block, wayside signaling technology, wherein trains are equipped with on-board train control equipment, wherein trains can determine their own locations independent of fixed block detection, wherein trains send their locations to a signal application platform, wherein the signal application platforms convert wayside signal aspects to corresponding movement authority limits that are transmitted to said train control equipment installed on-board trains.

BRIEF SUMMARY OF THE INVENTION

The foregoing and other objects of the invention are achieved in accordance with a preferred embodiment of the invention that provides a virtual train control system implemented in a cloud computing environment, and which is based on the moving block principle. Elements of the virtual train control system communicate with corresponding elements of a physical train control installation to send control data and receive status data. In its simplest form, the virtual train control system includes virtual trains, virtual zone controllers (application platform) and virtual track switches. The physical train control installation includes physical trains and physical track switches. Upon the initialization of the system, each physical train has a corresponding virtual train that operates in the virtual train control environment. Similarly, each physical track switch has a corresponding virtual switch in the virtual train control system. After initialization, the virtual track switches are synchronized with the corresponding physical switches such that each virtual switch reflects the position and status of the corresponding physical switch. Also each virtual train receives operating data from the corresponding physical train. The virtual trains interface with the virtual zone controller to send operating data, and receive movement authority limits. Then, the virtual trains send the movement authority limits to the corresponding physical trains. Each physical train is equipped with a train location determination subsystem, as well as odometry equipment that continuously calculate train location and measure its speed. The on-board train control equipment includes interfaces to the traction, braking and other car subsystems. Further, each physical or real train has an on-board data base that stores track topography data, including curves, grades and super elevation, etc., as well as data associated with civil speed limits. Each physical train then generates a stopping profile that controls the train movement from its current location to the limit of its movement authority received from the corresponding virtual train. Also, each physical train continuously updates its actual location and speed as calculated by the on-board equipment to the corresponding virtual train. Data related to work zones and temporary speed restrictions are relayed by virtual trains to corresponding physical trains.

It should be noted that the cloud computing environment could be located at a supplier's facility, or could be a private cloud computing facility at a secure location within the railroad or transit property. It should also be noted that the use of an on-board data base is a design choice. Data for track topography and civil speed limits could be uploaded to physical trains as a train moves from one zone to another. In addition, physical trains can employ a location determination subsystem of various designs, including a transponder based location determination subsystem, FIG. 8 inductive loops, radio triangulation devices, global positioning devices (GPS), or the like.

In the preferred embodiment, the physical interlocking of the train control installation includes the physical switch control equipment, and associated auxiliary train detection equipment (if required). The physical switch control equipment includes switch machines, point detection equipment, locking mechanism, operating devices, relays or other devices that check the switch correspondence function and switch locking condition. The interlocking subsystem of the virtual train control system (virtual interlocking) includes virtual switches that correspond to the physical switches, the signal control safety logic for the interlocking, non-vital logic for route selection, and the like. In addition, the virtual interlocking interfaces with the virtual CBTC system to provide an integrated train control system. The virtual interlocking elements communicate with the associated physical elements, wherein virtual switch machines send control information to physical switch machines, and receive position and locking data. It should be noted that while the physical interlocking equipment in the preferred embodiment is limited to the switch control equipment, the designer of the system may elect to add additional physical equipment, including train detection equipment, wayside interlocking signals, automatic train stop equipment, and the like. In such a case, the virtual train control system will include corresponding virtual equipment to the additional physical equipment.

For the preferred embodiment, a wireless data communication subsystem provides two way communications between the physical elements of the train control installation and a train control interface, which in turn communicates with the corresponding elements of the virtual train control system via a secured network connection. For large train control installations, the territory is divided into zones, wherein each zone employs its own wireless data communication subsystem. Further, each wireless data communication subsystem connects to a train control interface that in turn connects to the virtual train control system in the cloud computing environment.

The preferred embodiment also includes an Automatic Train Supervision (ATS) subsystem that enables operating personnel to control service delivery. Traditional work stations and display panels are connected to an ATS interface, which in turn is connected to a user interface through a secured network connection. The user interface provide the means for controlling train service by selecting routes, dispatching trains, regulating schedules, etc. in the virtual train control system. These train service parameters are reflected in the physical train control installation since the physical train control elements receive control data from the corresponding elements in the virtual train control system.

Although the preferred embodiment employs CBTC technology for the virtual train control system, any train control technology can be used in the cloud computing environment. Alternate embodiments are based on fixed block, cab-signaling technology and fixed block, wayside signaling technology. Further, this concept can be used in an embodiment that provides an overlay on an existing signal installation to enhance the safety and/or performance of the existing installation.

In a first alternate embodiment, the virtual train control system is related to fixed block, cab-signaling technology. In this first alternate embodiment, the virtual system is used to enhance the safety and performance of an existing cab-signaling installation. The existing installation employs fixed blocks for train detection (cab-signaling blocks), most likely audio frequency or coded track circuits. The existing installation also includes a cab-signaling application logic that generates speed codes. The virtual system also employs a fixed block configuration that is identical to the physical one.

The preferred design choice for the first alternate embodiment is to provide a virtual train control system in the cloud computing environment that converts the speed codes generated within the existing cab-signaling installation into movement authority limits. To accomplish such conversion, it is necessary to equip the physical trains operating in the existing cab-signaling installation with CBTC type car borne controller that performs CBTC like functions. This controller includes an independent train location determination subsystem, odometry equipment, a data base that stores information related to the topography of the tracks (i.e. data related to curves, grades, super elevation), and civil speed limits. Further, the controller interfaces with the car propulsion and braking systems. As such, the car borne controller determines current train location independent of fixed block detection, and controls the movement of the associated train pursuant to a movement authority limit (i.e. provides a distance-to-go operation). The independent location determination subsystem could be a transponder based installation, or could be based on any other location determination technology known in the art.

The virtual train control system, which is implemented in a cloud computing environment, includes a signal application platform and logical elements that are depicted as virtual trains, and which act as interfaces to the physical trains operating on the existing cab-signaling installation. Pursuant to the first alternate embodiment, each physical train determines its own location, and receives a cab-signaling speed code from the existing cab-signaling installation. Each physical train then transmits its location and cab-signaling speed codes to the corresponding virtual train in the virtual train control system. The virtual trains interface with the signal application platform, and provide the operating data received from the physical cab-signaling installation. The signal application platform includes a data base that stores data related to the physical cab-signaling installation, including the configuration of the cab-signaling blocks, the boundaries of each block, and a cab-signaling speed chart that provides the speed codes within each block for various traffic conditions ahead. These traffic conditions are associated with locations of trains ahead, status of wayside signal equipment, end of track, and the like.

The main function of the signal application platform is to convert cab-signaling speed codes to corresponding movement authority limits. To accomplish this main function, the signal application platform includes algorithms and/or logic that perform two main tasks. First, the signal application platform determines the cab-signaling block where a train is located (current train block) using the actual train location received from the physical train, and the cab-signaling block boundaries stored in its data base. Second, the signal application platform, using the current train block information and information stored in its data base, determines the location of the traffic condition ahead associated with the cab-signaling speed code. In effect, the traffic conditions ahead represent an obstacle on the track ahead. As such, the signal application platform converts the received cab-signaling speed code into a corresponding movement authority limit. The signal application platform then performs a safety check to verify that no trains are present within the limits of the calculated movement authority. The signal application platform relies on location information received from physical trains to perform this safety function. The signal application platform then transmits the movement authority limits to the virtual trains. The movement authority limits are thereafter transmitted by the virtual trains to the corresponding physical trains. Upon receiving a movement authority limit, the onboard train control equipment in a physical train generates a stopping profile that controls the movement of the train from its current location to the end of the movement authority limit. The stopping profile incorporates data related to the topography of the tracks as well as applicable civil speed limits.

It should be noted that the above description of a preferred design choice for the first alternate embodiment is being set forth herein for the purpose of describing the preferred embodiment, and is not intended to limit the invention hereto. As would be understood by a person with ordinary skills in the art, there are design variations that could be employed in the implementation of the first alternate embodiment. For example, the data base onboard the physical trains could include the configuration of the cab-signaling blocks and data related to the boundaries for each block. Under such installation, each physical train determines the cab-signaling block where the train is located (current train block), and transmits this information to the signal application platform together with the cab-signaling speed code. The signal application platform then performs a single task or step to convert the cab-signal speed code into a corresponding movement authority limit.

There are other design choices for the first alternate embodiment to provide a virtual train control system related to cab-signaling technology. For example, a virtual train control system could be implemented in a cloud computing environment to provide the signal application logic required to generate the cab-signaling speed codes for the physical cab-signaling blocks. Pursuant to this design option, the physical train control installation employs a fixed block configuration for train detection (either track circuits or axle counters). The virtual train control system also employs a fixed block configuration that is identical to the physical one. The occupancy statuses of the fixed blocks are transmitted from the physical installation to the corresponding blocks in the virtual system. A signal application platform is then implemented in the cloud computing environment to provide the logic to process the occupancy statuses of the physical cab-signaling blocks, and generate the cab-signaling speed code for each cab-signaling block. The speed codes are then transmitted to the physical blocks where they are injected into the rails.

Another variation of this design choice is to employ virtual trains in the virtual train control system to act as logical elements that interface with physical trains. In such case, the cab-signaling speed codes generated by the signal application platform are provided to the virtual trains, which in turn transmit them to the corresponding physical trains, using a wireless infrastructure, without the need to inject the speed codes into the rails. To implement this design choice, the physical trains are equipped with an independent location determination subsystem (such as a transponder based system), together with a data base that stores the configuration of the cab-signaling blocks (including the boundary locations for each block). This will enable a physical train to identify the cab-signaling block where the train is located ("current block"). The physical train will then send its "current block" information to the corresponding virtual train, and will receive a cab-signaling speed code from the virtual train via wireless means. As explained above, the "current block" function could be determined by the physical train using actual train location and an on-board data base. Alternatively, this function can be determined within the virtual train control system, using actual train locations transmitted by physical trains to corresponding virtual trains, and the data base within the signal application platform.

A second alternate embodiment demonstrates the use of virtualization and cloud computing resources to provide a train control installation that is based on fixed block, wayside signaling technology. The main objective of the second alternate embodiment is to provide an auxiliary wayside signal system, based on fixed block, wayside technology, and which can be implemented as a standalone system or in conjunction with a CBTC installation. Pursuant to the requirements of the second alternate embodiment, the physical train control installation employs fixed blocks for train detection, and wayside signals with automatic train stops to provide safe train separation. The virtual train control system employs an identical configuration of fixed train detection blocks and wayside signals. The fixed block train occupancy information is transmitted from the physical train detection block equipment to logical elements that depict corresponding fixed blocks in the virtual train control system. Similarly, the statuses of wayside signals and associated automatic train stops are transmitted from the physical signals to logical elements in the cloud computing environment that depict corresponding virtual signals. The vital signal control logic for the wayside signals is provided by a signal application platform implemented in the cloud computing environment. The virtual application platform generates control data that is transmitted to the physical installation to activate the appropriate signal aspects and the associated automatic train stops.

The second alternate embodiment employs a wireless data network for communications between the physical wayside signal locations and a signal interface module, which in turn communicates with the virtual train control system at the cloud computing environment. The wireless implementation has the advantage of minimizing the use of line copper cable. As such, the status information for a physical signal and its associated automatic stop is transmitted to the corresponding virtual signal via the wireless data communication subsystem. Also, the control data for the signal and associated stop is transmitted from the virtual signal to the associated physical signal.

One unique design feature that is provided by the second alternate embodiment is to transform the fixed block, wayside signaling operation into a distance to go operation. To implement this design feature, the virtual signal system implements an additional function that converts signal aspects to movement authority limits. In such a case, it is also necessary to equip the physical trains with CBTC type car borne controllers. This controller includes an independent train location determination subsystem, odometry equipment, a data base that stores information related to the topography of the tracks, and civil speed limits, and interfaces to the car propulsion and braking systems. The independent train location determination subsystem could employ transponder based technology, wherein passive transponders are located on the tracks to provide reference locations to trains. Each train then continuously determine its location based on the reference locations, and data provided by the on-board odometry equipment. Actual train locations are then transmitted to the virtual train control system, where the virtual system determines the wayside blocks where physical trains are located ("current block"). When a physical train approaches a wayside signal, a movement authority limit is transmitted to the physical train based on the status of the wayside signal. This movement authority is determined by the control line of the physical signal, and the aspect displayed at the signal. In a simple three aspect signal system, the control line is normally defined by the number of clear blocks needed to display a yellow aspect at the signal. A green aspect is normally displayed if the next signal is displaying at least a yellow aspect. Upon receiving a movement authority limit, the onboard train control equipment generates a stopping profile that controls the movement of the train from its current location to the end of the movement authority limit. The stopping profile incorporates data related to the topography of the tracks as well as applicable civil speed limits.

The above described design feature can be implemented as an overlay to an existing fixed block, wayside installation to enhance the safety and/or performance of the existing signal installations. The overlay is implemented as a virtual train control system in a cloud computing environment, wherein the existing fixed block installation is duplicated in the virtual system using logical elements that depict the physical signal equipment (train detection blocks and wayside signal). The overlay signal system provides two main enhancements.

First, the virtual signal system enhances the capacity of the physical signal installation by allowing trains to operate closer together (i.e. reduce train separation). The headway provided by an existing installation that employs fixed block, wayside technology is normally determined by the spacing between wayside signals. The headway is based on manual operation, and the assumption of a human error, wherein a train operator conducts a train at maximum attainable speed, and violates a red signal (a "stop" aspect). Train separation is then based on the braking distance associated with the maximum attainable speed at each signal location. Pursuant to this design features, CBTC type controllers are installed on-board existing trains to determine train location and provide distance-to-go operation. One of the safety functions provided by on-board train controllers is continuous over-speed protection. As such, when on-board controllers are installed on trains operating on the existing installation, train separation can be reduced by allowing trains to proceed past a red signal through an overlap block and to the end of the block in the approach to the block where a train ahead is located. This will enable trains to operate closer together, thus increasing track capacity and reducing the headway.

Second, the overlay signal system enhances the safety of the existing signal installation by detecting false clears, or the failure of a train detection block to detect a train. This is possible because the on-board controllers perform the function of determining train locations independent of fixed block detection. As such, there are two independent structures that determine train locations. The virtual train control system can implement an algorithm that compares the location information provided by these two structures, in order to detect and mitigate a false clear condition.

It should be noted that the new proposed concept of converting signal aspects to movement authority limits can be implemented independent of virtualization and the use of cloud computing resources. As would be understood by a person of ordinary skills in the art, new physical elements can be added to an existing wayside signal installation, including onboard equipment, and additional signal control logic to implement such conversion.

As demonstrated by the various embodiments described above, a virtual train control architecture implemented in a cloud computing environment provides a number of benefits, as well as a versatile approach to implement a new train control system or enhance an existing installation. This new approach allows train control suppliers and transit/rail properties to partition a train control installation into two main parts. The first part, which is expected to remain under the jurisdiction of the transit/rail property, includes physical elements such as trains (onboard train control equipment), and physical track equipment such as track switch control equipment, train detection blocks and wayside signals, etc. The second part, which could be placed under the jurisdiction of a train control supplier, includes the "brain" of the system (i.e. signal control logic, interlocking control, zone controller, etc.).

Implementing the second part in a cloud computing environment reduces the probability of a catastrophic failure, wherein an entire installation fails due to a failure in a signal application platform. Also, by placing the signal application platforms under the jurisdiction of suppliers, the rail/transit properties can focus on maintaining the physical equipment. Rail/transit properties can then delegate the maintenance of complex processor equipment, including data bases, to the system suppliers who are better equipped to perform such maintenance.

The proposed architecture, and the use of a cloud computing environment enables both the supplier and the rail/transit property to devise innovative plans to finance the initial capital cost of a new train control installation. For example, the supplier could offer the second part of the system as a service contract for the useful life of the signal installation. This will reduce the initial investment required by the transit/rail property to implement a new train control system.

Also, partitioning the train control installation into two parts makes it easier to define the interfaces for the purpose of achieving interoperability between suppliers, or between rail properties that share common tracks. For example, with respect to CBTC systems, the interfaces between zone controllers and on-board equipment are streamlined to interfaces between logical elements depicting virtual trains and physical trains. This enables the customization of operational functions to the individual train level.

In addition, the use of cloud computing environment enables the sharing of computer resources between a plurality of train control installations. In effect, the computing resources for an entire line can be provided by a secured cloud structure. Also, the proposed implementation approach enables suppliers to streamline the customization of an application platform to different customers with different requirements. The supplier can provide an application platform that reflects its core system, and implement the customized requirements in logical elements included in the virtual train control system. It should be noted that while a public cloud computing can be used, it is preferable to employ a secure private cloud for this train control application. It should also be noted that the cloud computing environment could be located at a supplier's facility, or it could be installed at a secured location within the transit/rail property.

Further, the partitioning of a train control installation, and placing the "brain" of the system under the jurisdiction of a supplier, makes it easier to implement changes and upgrades to the train control installation, especially if such changes and upgrades are related to computer hardware changes and/or changes in the operating system. In effect, it would be easier for suppliers to manage obsolescence, by replacing components within its jurisdiction, thus increasing the useful life of an installation. In addition, because the physical elements of a train control installation (detection block, signal, switch control module) are independent of the train control technology used, and because the virtual architecture makes it feasible to convert operation under various technologies into a distance-to-go operation, the proposed virtual architecture makes it feasible to achieve interoperability between train control systems that employ different technologies.

Furthermore, the proposed virtual architecture can provide a number of safety and operational benefits to existing signal installations. By duplicating an existing installation in a virtual computing environment, it is easier to make modifications to the existing system in the virtual computing environment for the purpose of converting an existing manual or cab-signaling operation to CBTC type operation, increasing track capacity and enhancing safety of operation.

In turn, transforming an existing operation to a distance-to-go operation provides other benefits, including smoother and more efficient operation through the elimination of the "step function" type operation provided by cab-signaling, or the manual operation associated with fixed-block, wayside signaling installations. The distance-to-go operation has the unique benefit of making the train propulsion and braking characteristics independent of the wayside fixed block design (cab-signaling or wayside signaling), and facilitates the transition from existing installations to CBTC operation during signal modernization projects. Further, the conversion to distance-to-go operation enables mixed fleet operation with trains that have different characteristics. For example, a rail property can operate freight trains on the same tracks with commuter trains. In such a case, each type of train will operate on the line based on its own propulsion and braking characteristics and independent of the assumptions made for the existing wayside block design.

BRIEF DESCRIPTION OF THE DRAWINGS

These and other more detailed and specific objectives will be disclosed in the course of the following description taken in conjunction with the accompanying drawings wherein.

DESCRIPTION OF THE PREFERRED EMBODIMENT

Figure 1:
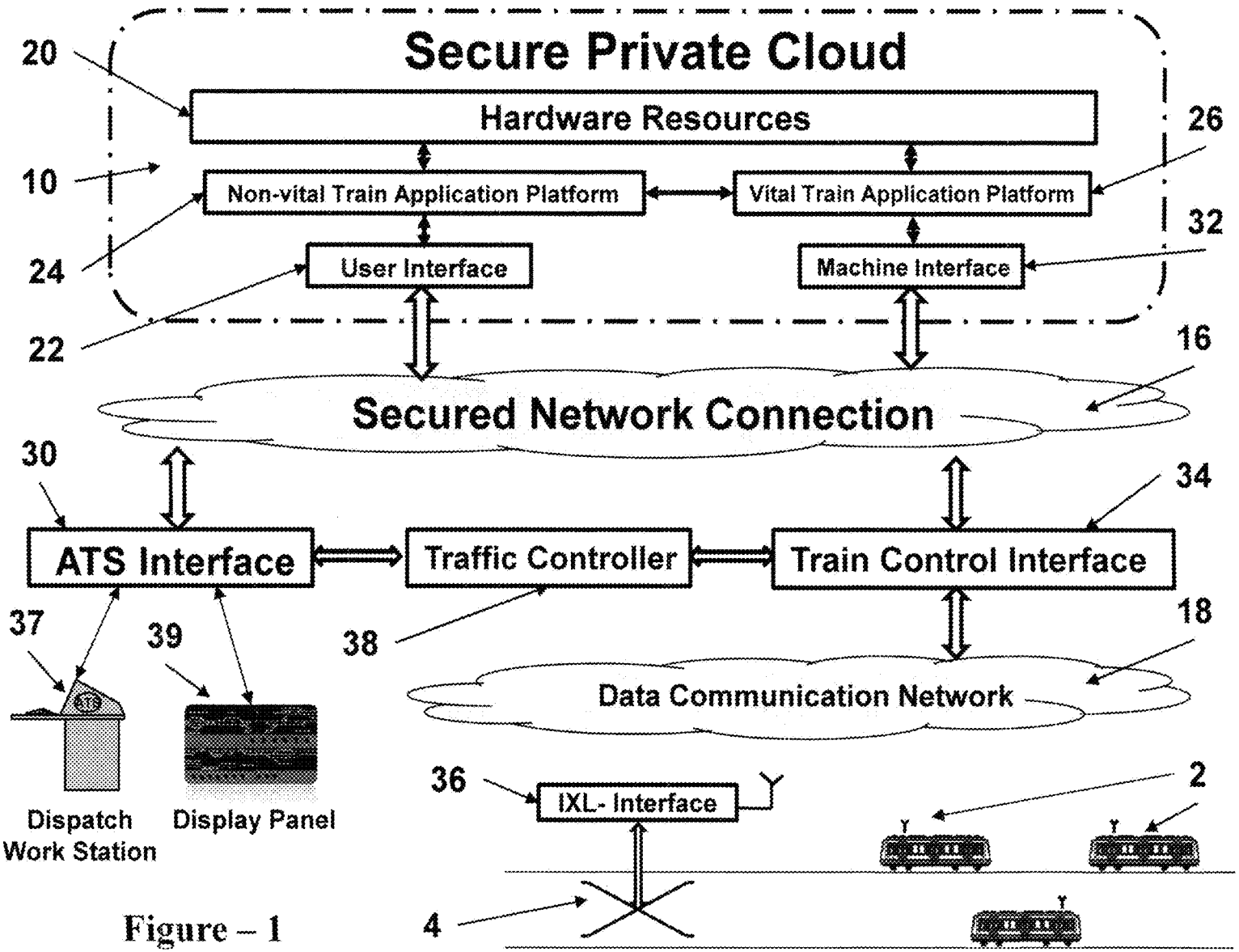
FIG. 1 is a general block diagram of a train control system implementation showing a cloud computing environment and a physical train control installation in accordance with the invention.

The present invention describes a new structure, and/or a new method to implement train control installations. This new implementation approach is based on cloud computing, and takes advantage of virtualization in order to partition a train control installation into two main parts. The first part, which is defined as the physical part, includes the onboard train control devices and the trackside signaling and train control equipment such as train detection devices, signals, track switch control equipment, and the like. The second part is defined as the virtual train control system, and includes the processing resources and associated train control application platforms that implements both safety critical and non-vital train control functions. Further, the second part includes a virtualization of the physical components included in the first part, which act as logical elements that interact with the train application platforms to provide a complete train control system in the cloud environment. The logical elements are also used to provide the interfaces between the physical installation and the virtual train control system. As such, each of the logical (virtual) elements of the virtual train control system communicates with a corresponding physical element in the train control installation. For example, in a communication-based train control implementation, a virtual on-board train control module or computer communicates with the on-board train control module or computer for the corresponding physical train. In general, a physical element provides status information to, and receives control data from, the corresponding virtual element. In the above CBTC example, the virtual on-board train control computer receives train location and speed information from, and sends movement authority limit data to the on-board train control computer for the corresponding physical train.

The use of cloud computing and associated virtualization provides a secure, highly available, agile and versatile computing environment for train control applications. It is preferable that the train control supplier maintains jurisdiction over the cloud computing environment. This will enable the user/operator at the transit or rail property to take the benefits of new technologies, without the need for deep knowledge of the technologies, and without the burden, responsibility and expense of maintaining new technology installations. Additional benefits of this approach are identified in the Summary Section of this application.

The preferred embodiment applies this new implementation approach to communication based train control (CBTC) technology, wherein the train control installation is partitioned into a physical installation that includes vital onboard computers that control the physical trains operating on the system, and the trackside signaling devices, and a virtual train control system located in a cloud computing environment. For the preferred embodiment, the virtual train control system includes the CBTC zone controllers (ZC) application, the Solid State Interlocking (SSI) control application, the Automatic Train Supervision (ATS) application that provide route selection and other service delivery functions, and the interfaces between ZC, SSI and ATS subsystems. The virtual train control system also includes logical elements that represent and emulates the operation of physical onboard computers and physical trackside signal equipment. The cloud computing provides a secure, highly available (almost fault free), versatile, and maintenance free (for the transit operator) environment to implement vital CBTC and interlocking functions, as well as non-vital and ATS functions.

Referring now to the drawings where the illustrations are for the purpose of describing the preferred embodiment of the invention and are not intended to limit the invention hereto, FIG. 1 is a block diagram of the general architecture used to implement a train control installation. The physical installation includes the trains operating on the line, wherein each train is equipped with an onboard train control computer 2, which controls the safe operation of the train; an interlocking 4 that comprises an interlocking interface module 36 and the physical trackside signal devices such as track switches and associated controls, signals, train detection equipment, etc.; ATS interface 30 that is connected to a user interface 22 at the cloud computing environment 10 through a secure network connection 16, and which is also connected to dispatcher workstations 37 and display panels 39 for the operators to control and monitor service delivery; a traffic controller 38 that generates service schedules and time tables; and a train control interface 34 that connects to a machine interface 32 at the cloud computing environment 10 through a secure network connection 16, and which provides the main interface between the virtual train control system and the onboard train control computers 2 & the interlocking interface 36. The physical installation also includes a data communication network that provides two way wireless communications between the train control interface 34, and the onboard train computers 2 & the interlocking interface 36.

The cloud computing environment 10 includes the hardware resources 20 needed for the implementation of the vital train application platform 26 (zone controllers and solid state interlocking control devices), as well as the non-vital application platform 24 (ATS servers and other non-vital subsystems). The cloud computing environment 10 also includes the user interface 22 and the machine interface 32.

It should be noted that the architecture shown in FIG. 1 is presented herein for the purpose of describing the preferred embodiment, and is not intended to limit the invention hereto. For example, a transit property could elect to include the ATS servers as part of the physical installation. Also, the interconnection between the train control interface and the interlocking interface could be implemented through wire connection rather than the indicated wireless connection. Another alternative is to integrate the interlocking interface within the train control interface. Further, depending on transit property preference and/or standards, the interlocking equipment could be limited to switch machines and associated controls, or could include traditional train detection equipment and wayside signals. In addition, the traffic controller could be integrated as part of the ATS subsystem either at the cloud computing environment or within the physical installation.

Although it is desirable to locate the cloud computing resources at the train control supplier's facility, it is a design choice, or based on the implementation requirements, to place the cloud computing resources at a different location. For example, the cloud could be located at a secure facility that belongs to the transit or rail property, or it could be located at a facility managed by a third party provider. Further, the type of cloud used is a design choice, and could include a private internal, a hybrid cloud or an external cloud. In addition, the level of control the user (transit property) has over an application running in the cloud is a design choice and is subject to the understanding and agreement between the transit or rail property and the train control supplier (host).

Figure 2:
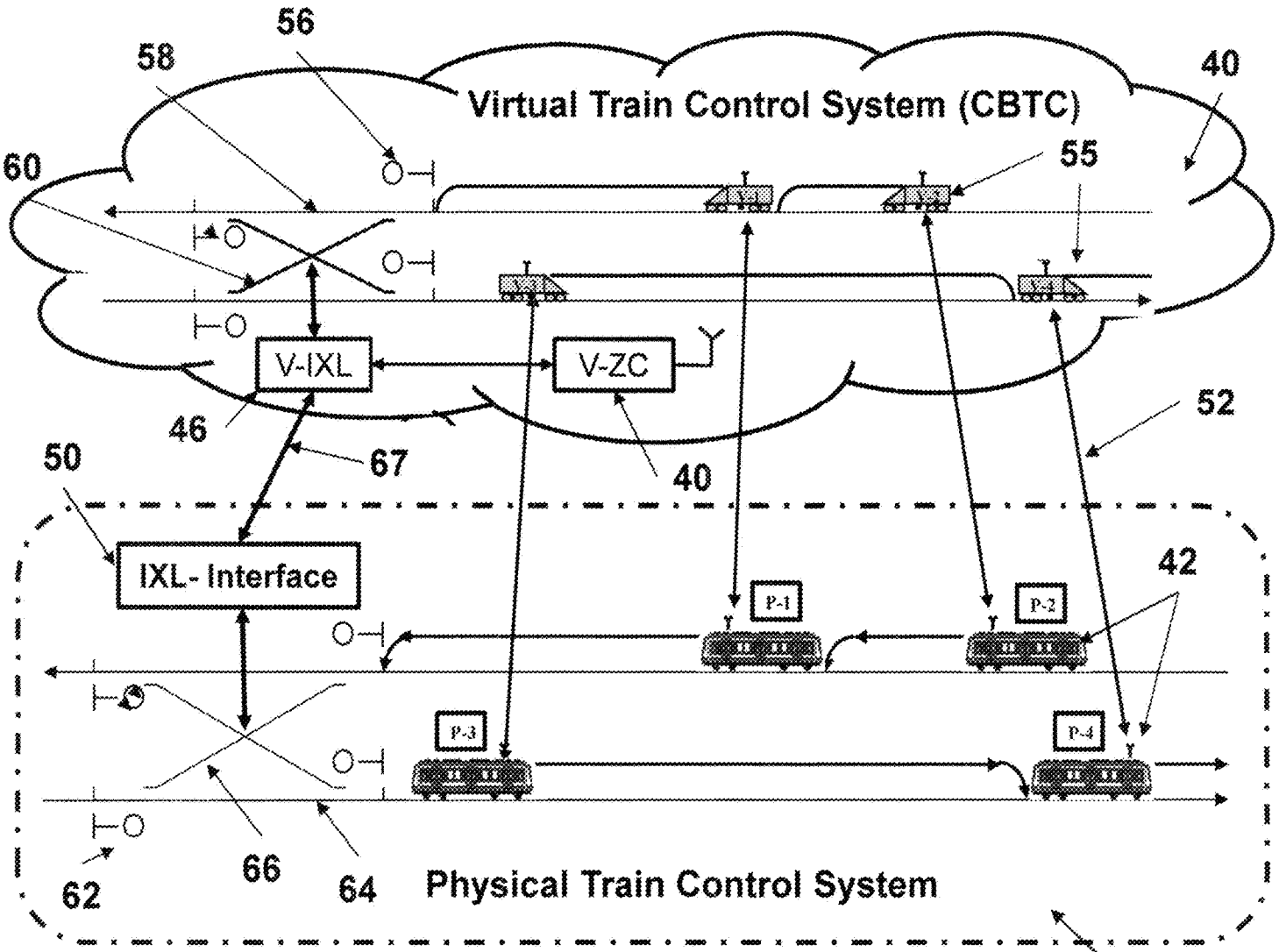
FIG. 2 shows the physical and virtual parts of a Communications Based Train Control (CBTC) implementation, indicating communications between physical elements and logical (virtual) elements in accordance with the invention.

FIG. 2 shows the main physical elements of a CBTC implementation and the corresponding logical elements in the virtual system within the cloud computing environment. Both the physical train control system 44 and the corresponding virtual train control system 40 have an identical track configuration and an identical number of trains operating in the territory. Further, the trains are shown at the same track locations at both the physical and virtual systems. In that respect, physical trains P-1, P-2, P-3 and P-4 42 correspond to virtual (logical) trains V-1, V-2, V-3 and V-4 55. Similarly, physical track side interlocking devices: train detection blocks 64, switch control equipment 66, and wayside signals 62 correspond to the virtual (logical) interlocking devices: train detection blocks 58, switch control equipment 60, and wayside signals 56. The virtual train control system also includes the zone controller application platform V-ZC 40 and the interlocking control application platform V-IXL 46. The physical train control system includes the interlocking interface module 50.

In addition, FIG. 2 shows the communications between physical trains and corresponding virtual (logical) trains 52, as well as communications between the physical interlocking devices and the virtual interlocking control platform 66.

The ATS physical and virtual elements are not shown in FIG. 2. It should be noted that FIG. 2 depicts a section of the operating railroad. Similar to conventional train control system implementations, to equip an entire line with a train control system using this approach, the line is divided into sections. For each section, the train control system is partitioned into a physical installation and a virtual train control system. Trains are tracked as they move from section to section in both the physical and virtual environments. However, as stated above, an entire line can share the same cloud computing resources.

Figure 3:
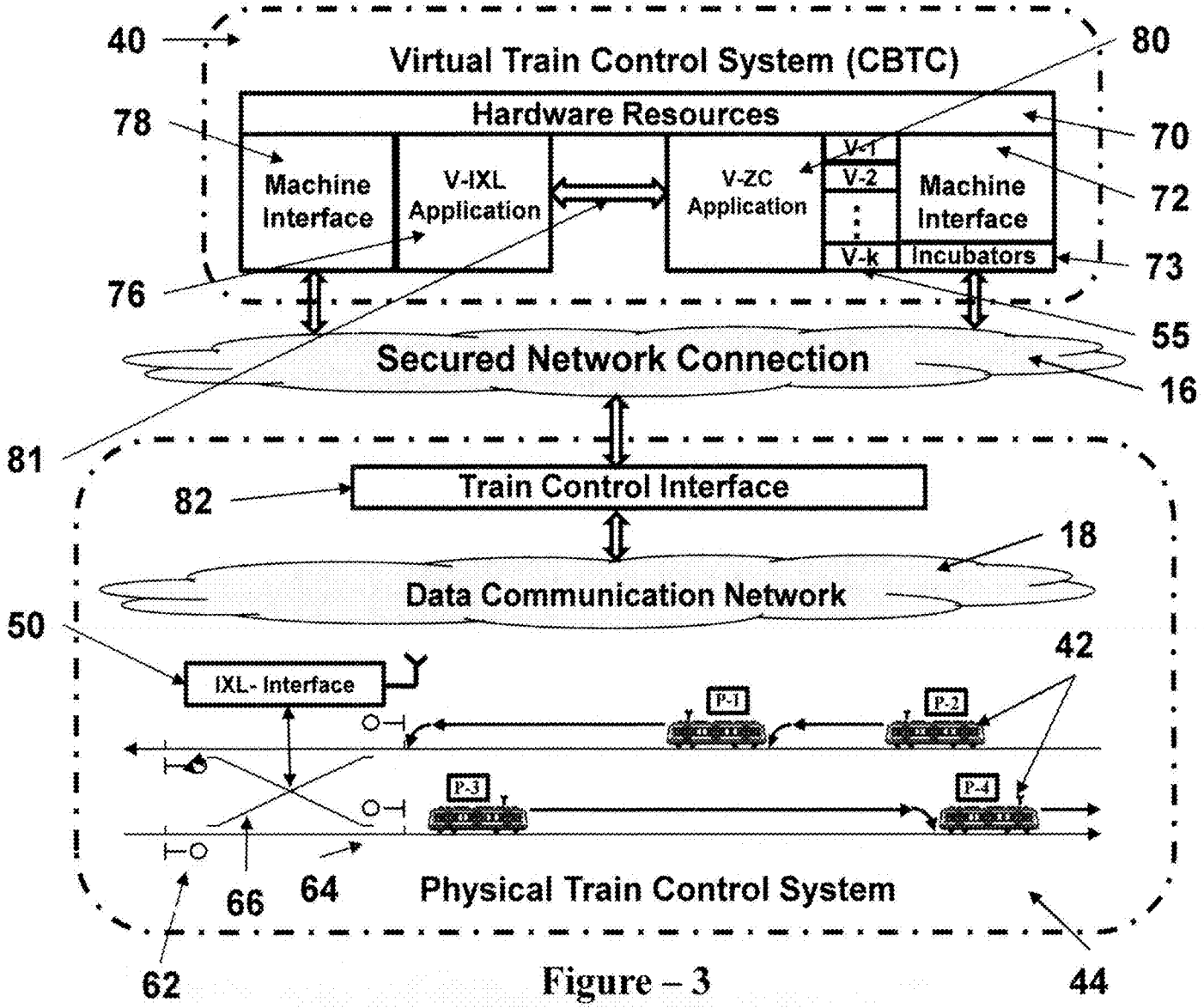
FIG. 3 shows a block diagram of a CBTC implementation, indicating the physical train control elements, and the cloud computing resource elements that provide the virtual CBTC train control system.

FIG. 3 shows a block diagram of the CBTC implementation in a section of the railroad, and demonstrates how the CBTC system is partitioned into a physical CBTC installation 44 and a virtual train control system (CBTC) 40. The physical CBTC installation 44 includes a train control interface 82, a data communication network 18, an interlocking interface module 50, onboard train control computers (for trains P-1, P-2, P-3 & P-4) 42, and trackside interlocking devices: train detection blocks 64, switch control equipment 66 and wayside signals 62. The virtual train control system 40 includes the hardware computing resources 70 for the various train control application platforms, including the zone controller application platform 80, the solid state application platform 76, and the application platform that emulates the onboard train control computers 55. Since the number of trains operating in the territory can vary, the virtual train control system provides a plurality (k) of computing modules 55 that emulate the onboard train control computers. Therefore, the maximum number of trains that can operate in this section of the railroad is limited to k.

Figure 7:
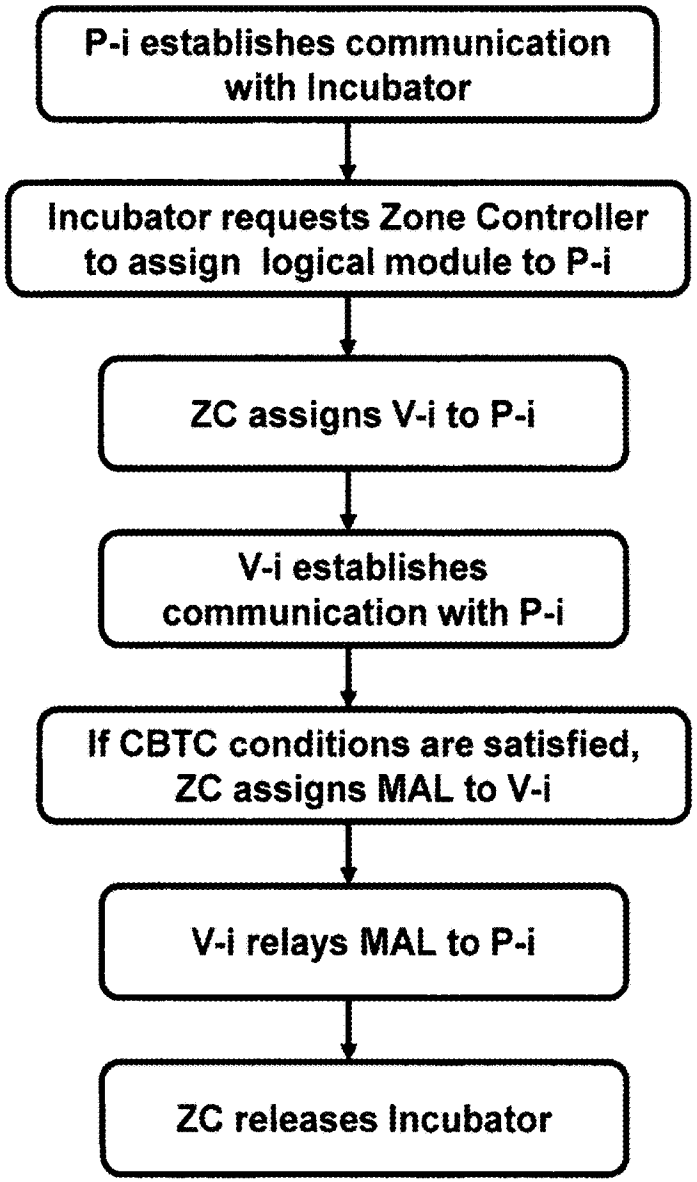
FIG. 7 shows the steps in the process to assign and initialize a virtual train for CBTC operation in the cloud computing environment.

The virtual train control system 40 also includes a plurality of logical elements or modules 73 that act as incubators to initialize a new train detected in the physical installation into the virtual train control system. This initialization process is not applicable to trains moving from adjacent sections of the railroad into this section. Those train are tracked by the system, and move from one section into an adjacent section (in both physical and virtual environments) using a transition process. Rather, the incubator process is intended to initialize a physical train when it is first detected in the train control installation. As a new physical train (P-i) is detected in the section, it is necessary to establish a corresponding virtual train in the virtual train control system. For the preferred embodiment, which implements CBTC technology, the detection is through radio communication. The initial frequency or radio channel assigned to the train is designed and/or configured to establish communication with one of the plurality of incubators 73. Upon establishing such communication, the incubator requests the zone computer 80 to initialize train P-i into the virtual system 40. It should be noted that this initialization is different from the initialization of a train into CBTC operation. The preconditions for CBTC train initialization include train localization and sweeping of relevant track section. Upon receiving a request from the incubator, the zone controller assigns an available logical module (virtual train) V-i to P-i. Then upon establishing communication between P-i & V-i, and if the pre-conditions for CBTC train initialization are satisfied, the zone computer 80 will issue a movement authority limit to V-i, which in turn will relay the movement authority to P-i. After the completion of this initialization process for train P-i, the zone computer releases the incubator so that the process is repeated when a new train is detected in this railroad section. The above described initialization process is shown in FIG. 7. It should be noted that if physical train P-i does not meet the preconditions for CBTC initialization, it will still communicate with virtual train V-i, but will not be assigned a movement authority.

Figure 4:
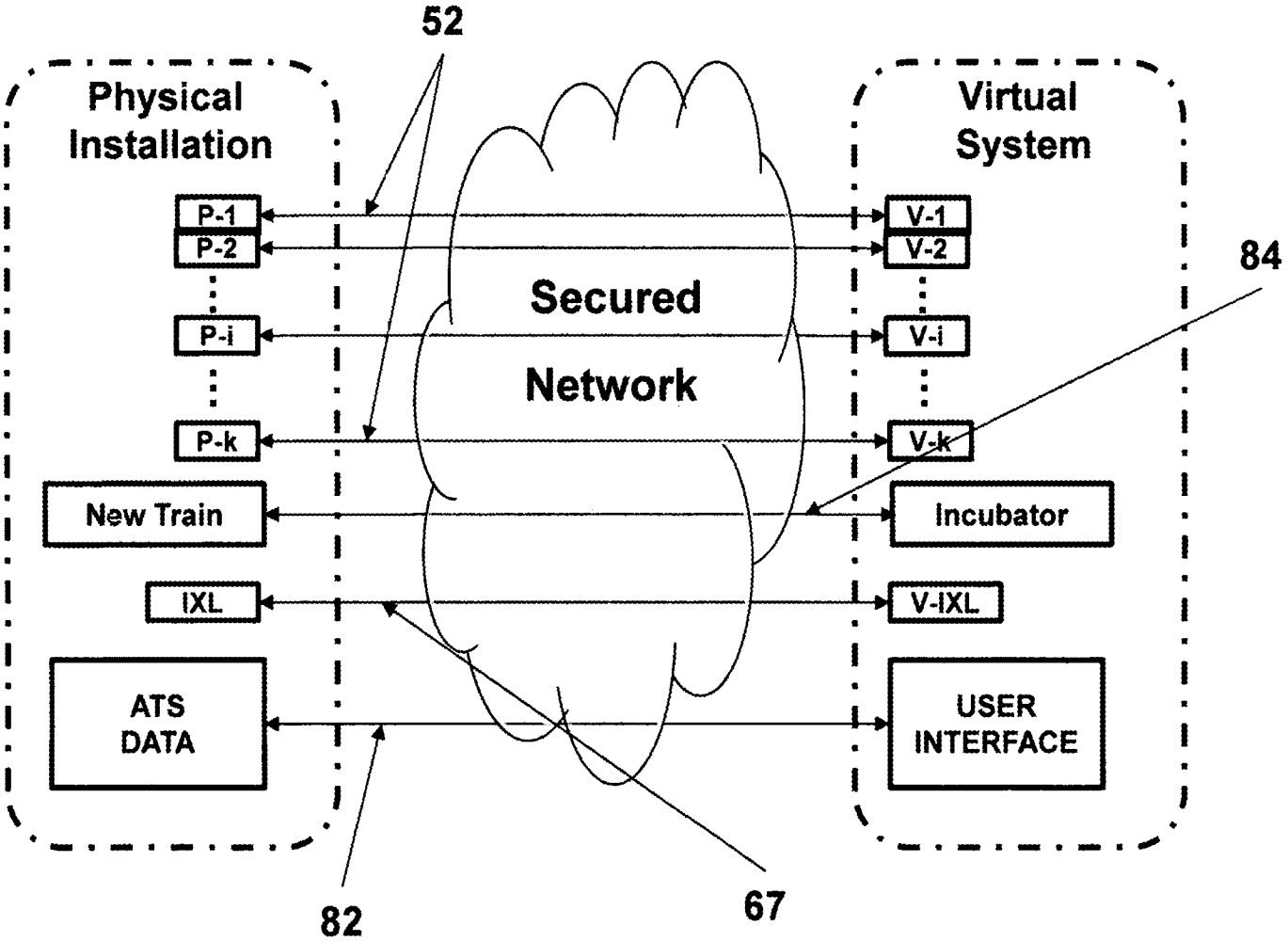
FIG. 4 shows the main communication channels required between the physical installation and the virtual train control system for a CBTC system implementation.
Figure 5:
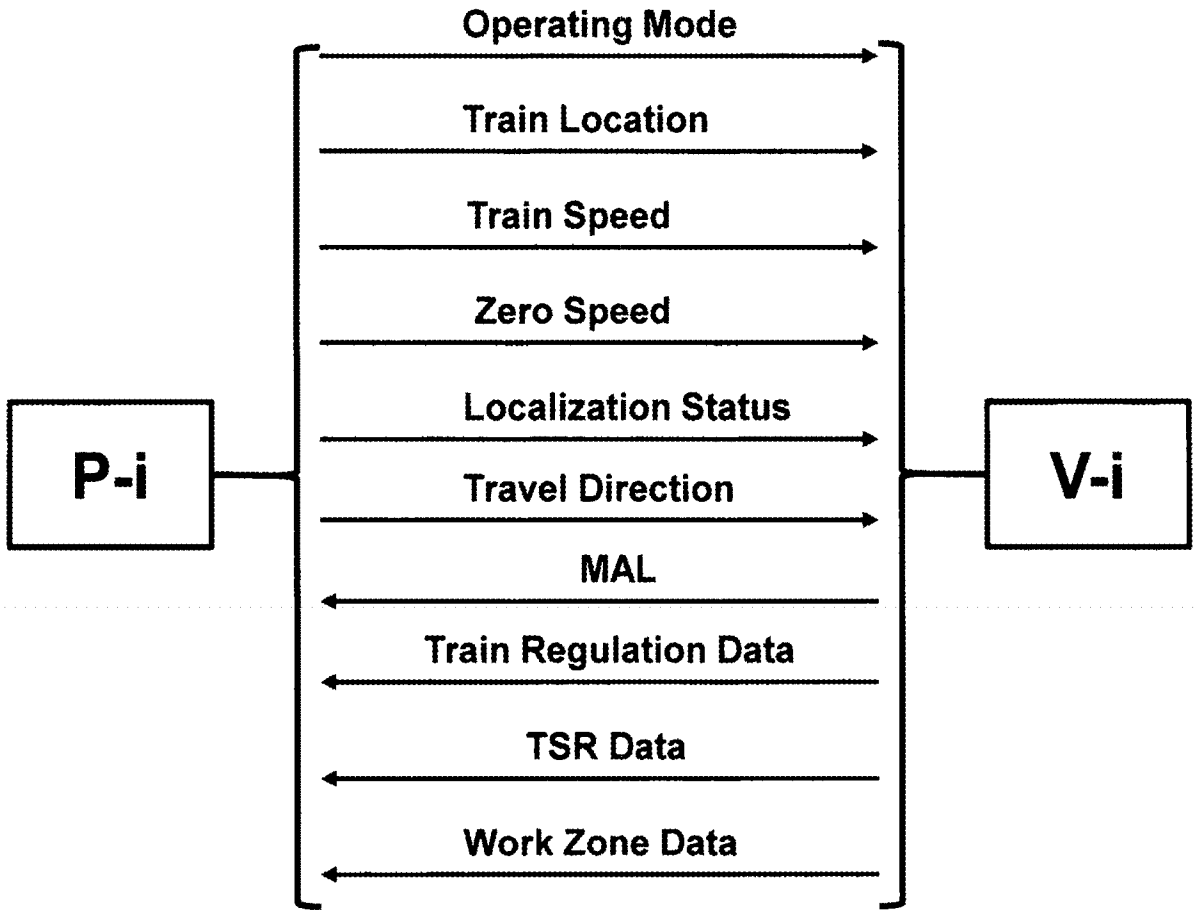
FIG. 5 shows the main data and information exchanged between a physical CBTC train controller and a corresponding logical element (virtual train) in the cloud computing environment.

The virtual train control system (CBTC) 40 also includes machine interfaces 72 & 78 that represent the demarcation points for communications with the physical train control installation through a secure network connection 16. In that respect, FIG. 4 shows the main communication channels between the physical installation and the virtual train control systems for CBTC implementation as per the preferred embodiment. In general, two way communications is required between physical trains and virtual (logical) trains 52, between new detected trains and incubators 84, between physical and virtual interlocking elements 67, and between the ATS of the physical installation and the user interface at the virtual train control system 82. FIG. 5 shows the various status information and control data exchanged between physical train P-i and corresponding virtual train V-i. It should be noted that the specific status information and control data shown in FIG. 5 are set forth for the purpose of describing the preferred embodiment, and are not intended to limit the invention hereto. As would be understood by a person of ordinary skills in the art, additional or different status information and control data may be exchanged between a physical train and a corresponding virtual train depending on CBTC system requirements and design.

Figure 6:
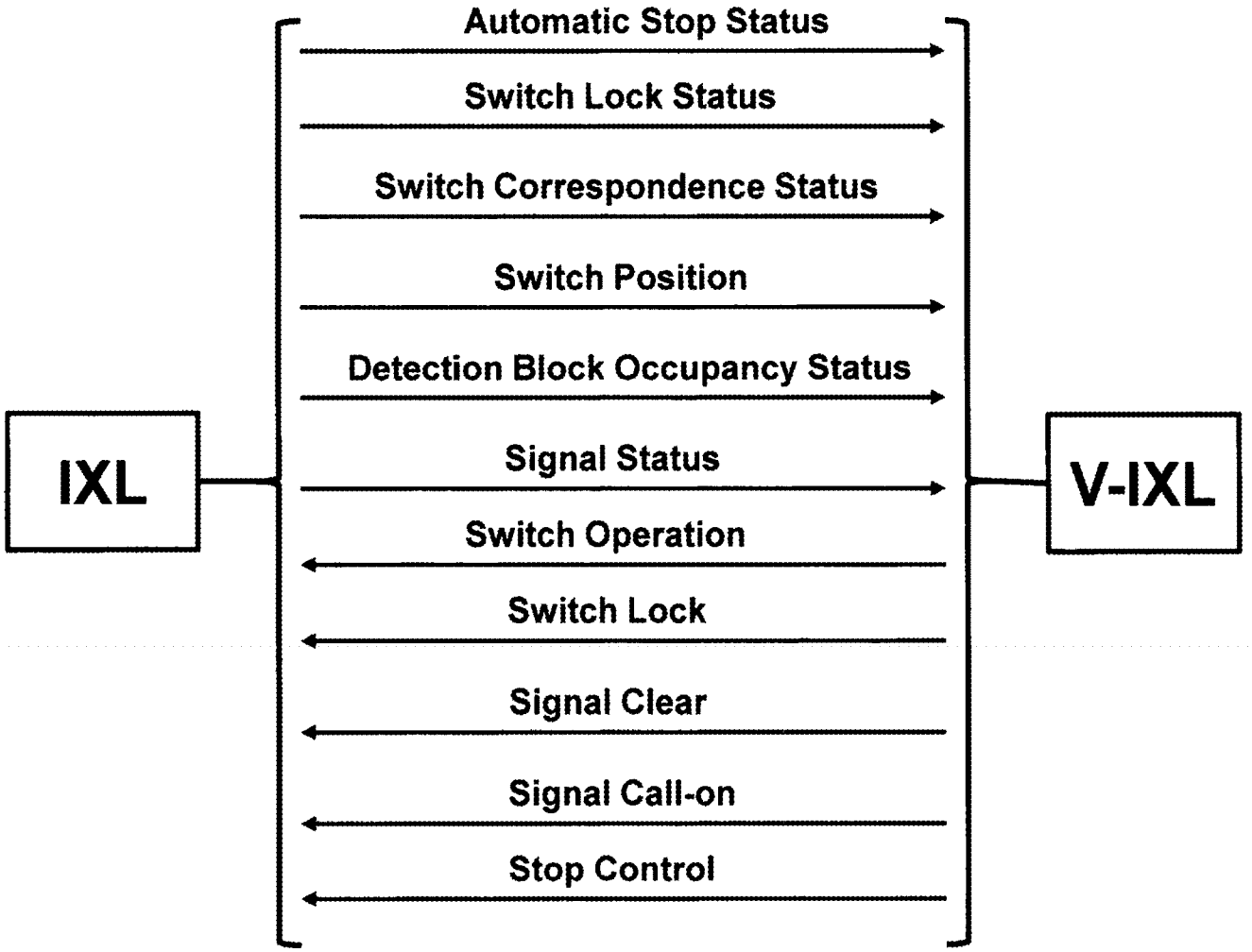
FIG. 6 shows the main data and information exchanged between a physical interlocking control device and a corresponding logical element (virtual interlocking control device) in the cloud computing environment.

Similarly, FIG. 6 shows the various status information and control data exchanged between physical interlocking elements and corresponding virtual elements. It should be noted that although it is not shown in FIG. 3, the preferred embodiment includes as part of the V-IXL application platform 76 individual logical elements that emulate the various trackside interlocking devices. These logical elements represent virtual interlocking devices and act as the interfaces between the signal control logic included in the V-IXL application platform 76, and the IXL Interface 50 that connects to the trackside interlocking devices 62, 64 and 66. It should also be noted that the specific trackside interlocking equipment will vary from system to system and from location to location, and as such the specific status information and control data exchanged between the physical installation and the virtual system will vary from installation to installation. In addition, the V-IXL application platform 76 could be based on an interlocking rules approach or could employ Boolean equations to implement signal control logic. As such, the specific implementation approach may require different and/or additional status information and/or control data exchanged between the physical installation and the virtual system. All such variations described above are within the scope of this invention.

Further, it should be noted, and as would be understood by a person with ordinary skills in the art, the interlocking configuration depicted in FIGS. 1, 2 & 3 could be different, and could include wayside signals between interlockings to provide an auxiliary wayside signal (AWS) system to enable train service with signal protection during CBTC failures. In such a case, the entire system (CBTC and AWS) will be partitioned into a physical installation and a virtual train control system as described above. For the preferred embodiment described in FIG. 3, the interfaces 81 between CBTC 80 and the interlocking system 76 are implemented in the virtual train control system 40. This will facilitate the integration of the interlocking functions into CBTC operation.

With respect to the main operation of the CBTC system described in FIG. 3, after system and train initializations, each physical train P-i 42 transmits its location to the corresponding virtual train V-i 55 in the virtual train control system. In turn, each virtual train V-i 55 transmits its location to the zone computer 80. The zone computer 80 issues movement authority limits to the virtual trains 55 based on the latest train locations data received. Each virtual train 55 then sends the received movement authority to the corresponding physical train 42. Upon receiving a movement authority limit, a physical train P-i generates a stopping profile from its current location to the end of the received movement authority limit, using track topography data stored in its vital on-board data base, and taking into account any civil speed limits reflected in the data base. The onboard computer then ensures that the physical train does not exceed the speed and the movement authority limit defined by the stopping profile. As the physical trains move on the track, they update their locations to the corresponding virtual trains, which report their updated locations to the zone computer. In turn the zone computer updates the movement authority limits to the various trains operating on the system, and the cycle repeats. For movement through an interlocking route, the zone computer ensures that the interlocking route is clear and that the switches are properly aligned and locked before issuing a movement authority through the route.

One of the advantages of the proposed CBTC architecture described in FIG. 3 is that it enables the implementation of temporary train functions for selected physical trains by incorporating such functions in the corresponding logical modules (virtual trains) at the virtual CBTC train control system. Since the logical modules act as the interface between the zone computer in the virtual environment and the onboard computers for the physical trains, and since the status information and control data for a specific physical train are available at the corresponding logical element, it is desirable to include temporary functions within the logical modules. For example, it may be necessary to limit the movement authority for a particular train, or a group of trains, to a predefined distance from current train location. Generally, the zone computer issues a movement authority that extends from current train location to the location of a train ahead. If a generated movement authority is longer than said predefined distance, then the logical module will truncate the movement authority received from the zone computer to the predefined distance before transmitting it to the corresponding physical train. The logical module can then monitor the location of the train, and will periodically transmit the remainder of the movement authority received from the zone computer, one section at a time, until the train reaches the limit of the authority generated by the zone computer.

Another example of the use of a logical module to implement a temporary train control function is to limit the operation of a specific train to a particular mode, or to exclude a mode of operation for that train. In general, the logical modules can be programmed to include a plurality of additional train control functions that can be exercised for a specific train or a group of trains if service conditions require it.

In addition, in the case of driverless operation, and if a physical train fails in revenue service, the corresponding logical module could be interfaced with a train simulator that has provisions for manual train controls. The train simulator could then be used to remotely operate the disabled or failed train up to the next station, where the train could be taken out of service.

With respect to failure modes management for the preferred embodiment, the proposed architecture has the added benefit of providing an almost fault free cloud computing environment for CBTC and interlocking application platforms. As such, a total failure of a zone computer application or a solid state interlocking control application is very unlikely. Potential failures of the installation that are unique to the proposed architecture include a loss of communication between a physical train and a virtual train, a loss of communication between physical interlocking elements and corresponding virtual elements, or a total loss of communication within a section of the railroad. If a physical train loses communication with its corresponding virtual train, the physical train will come to a full stop, and can be operated in a restricted manual mode, wherein its speed is limited. The corresponding virtual train will lose its movement authority limit, and its location will not be updated until communication is re-established with the physical train. It should be noted that when a virtual train loses communication with a physical train, it remains assigned to the physical train until communication is re-established, or the virtual train is released for reassignment by the system administrator (case when the physical train is taken out of service or leaves the section of the railroad).

Similarly, if communication is lost between the physical interlocking elements and the corresponding virtual elements, the physical elements will revert to the safe state (wayside signals will display a "stop" aspect, and switches will remain in the last position). Within the virtual train control system, all affected virtual train detection blocks will reflect an "occupied" status, all affected virtual switches will reflect "out of correspondence," and all affected virtual signals will reflect "stop" aspect. The zone computer application will then determine the impact of the loss of communications on any issued movement authority limits, and will cancel all movement authorities affected by this loss of communications. In turn, affected virtual trains will relay the cancellation of movement authorities to corresponding physical trains. In the unlikely event of a total loss of communications between the physical train control installation and the virtual train control system, all affected physical trains will be brought to a full stop, and all affected wayside signal will display a "stop" aspect. In the virtual system, all affected virtual trains will lose their movement authority limits, and all affected virtual interlocking devices will assume a safe state. Upon reestablishing communications, the system and all trains operating in the section need to be initialized before normal train operation can resume.

As would be understood by those skilled in the art, alternate embodiments could be provided to implement a CBTC system using new concepts described herein. For example, the interlocking application platform could be implemented as part of the physical installation. Also, alternate cloud computing architecture could be used to implement the virtual train control system. Further, a different communications configuration could be used to exchange status information and control data between the physical train control installation and the virtual train control system. It is also to be understood that the foregoing detailed description of the preferred embodiment has been given for clearness of understanding only, and is intended to be exemplary of the invention while not limiting the invention to the exact embodiments shown.

Description of a First Alternate Embodiment

The objectives of the invention could also be achieved by a first alternate embodiment that provides a train control installation, which employs cab-signaling technology. This embodiment takes advantage of cloud computing and virtualization in order to enhance the safety and performance of existing cab-signaling installation, or alternatively to provide a new train control installation. For the remaining description of this first alternate embodiment, it is assumed that the scope of the cloud computing implementation is to enhance the safety and performance of an existing cab-signaling installation. As such, the main objectives of this implementation include providing positive train control (PTC), and enhancing the track capacity of the existing installation (i.e. reduce the operating headway). Other objectives include protection against wrong-side track circuit failure (false clear), enforcement of civil speed limits and temporary speed restrictions, provide a CBTC type operation (distance-to-go operation), and modernization of existing interlocking control devices. It should be noted that the above scope of work and objectives are set forth herein for the purpose of describing the first alternate embodiment, and are not intended to limit the invention hereto. As would be appreciated by a person of ordinary skills in the art, if the scope of the cloud computing implementation includes providing a new train control installation based on cab-signaling technology, then the objectives of the implementation could include the same or different objectives as set forth herein.

Similar to the preferred embodiment, the train control installation for the first alternate embodiment is partitioned into two main parts. The first part includes the existing cab-signaling installation augmented by an independent train location determination subsystem, a wireless data network that provides two-way communications between physical trains and wayside interface modules, train control devices on-board physical trains that provide CBTC type operation (i.e. distance-to-go operation) in addition to cab-signaling operation during certain failure modes, and interlocking interface modules to monitor and control track side interlocking devices. The independent train location determination subsystem could be implemented using transponder based technology, wherein transponders are installed on the track bed to provide reference locations. Between transponders, trains continue to compute their locations and speeds using on-board odometry devices. The train location determination subsystem could also be based on global position satellite (GPS) technology, FIG. 8 loops, triangulation of radio signals, etc.

The second part of the installation is defined as the virtual train control system, and includes the processing resources and associated train control application platforms that provide the safety critical train control functions necessary to achieve the objectives of the first alternate embodiment. Further, the second part includes a virtualization of physical components included in the first part, which act as logical elements that interact with the train application platforms to provide a complete train control system in the cloud environment. The logical elements are also used to provide the interfaces between the physical installation and the virtual train control system. As such, each of the logical (virtual) elements of the virtual train control system communicates with a corresponding physical element in the train control installation. For example, a virtual on-board train control module (or computer) communicates with the on-board train control module or computer for the corresponding physical train. For the first alternate embodiment, virtual on-board train control computer receives train location and cab-signaling speed code information from, and sends movement authority limit data to, the on-board train control computer for the corresponding physical train.

The virtual train control system includes a MAL Conversion Processor (MCP), which includes a data base that stores information related to track topography (curves, grades, super elevation, etc.), locations and types of signal equipment on the track, including transponders, civil speed limits, cab-signaling blocks and their boundaries, and speed code charts that indicate the cab-signaling speed codes for each block for various traffic conditions (i.e. the block ahead where an obstacle is located. An obstacle includes a train ahead, a signal displaying a "stop" aspect, a switch out of correspondence, an end of track, etc.). The MCP converts speed codes generated by the physical cab-signaling speed codes, and transmitted from physical trains to virtual trains, into movement authority limits (MAL). The MCP also checks the integrity of the cab-signaling detection blocks by ensuring that there are no physical trains located within the boundaries of a generated MAL. In addition, based on the scope of work of the first alternate embodiment, the virtual train control system includes Solid State Interlocking (SSI) control application that provide the vital logic necessary to control the physical trackside interlocking devices. The virtual train control system also includes logical elements that represent and emulates the operation of on-board computers located at physical trains, and physical trackside signal equipment. The cloud computing provides a secure, highly available (almost fault free), versatile, and maintenance free (for the transit operator) environment to implement the enhancements to the existing cab-signaling installation and the required interlocking functions.

Figure 10:
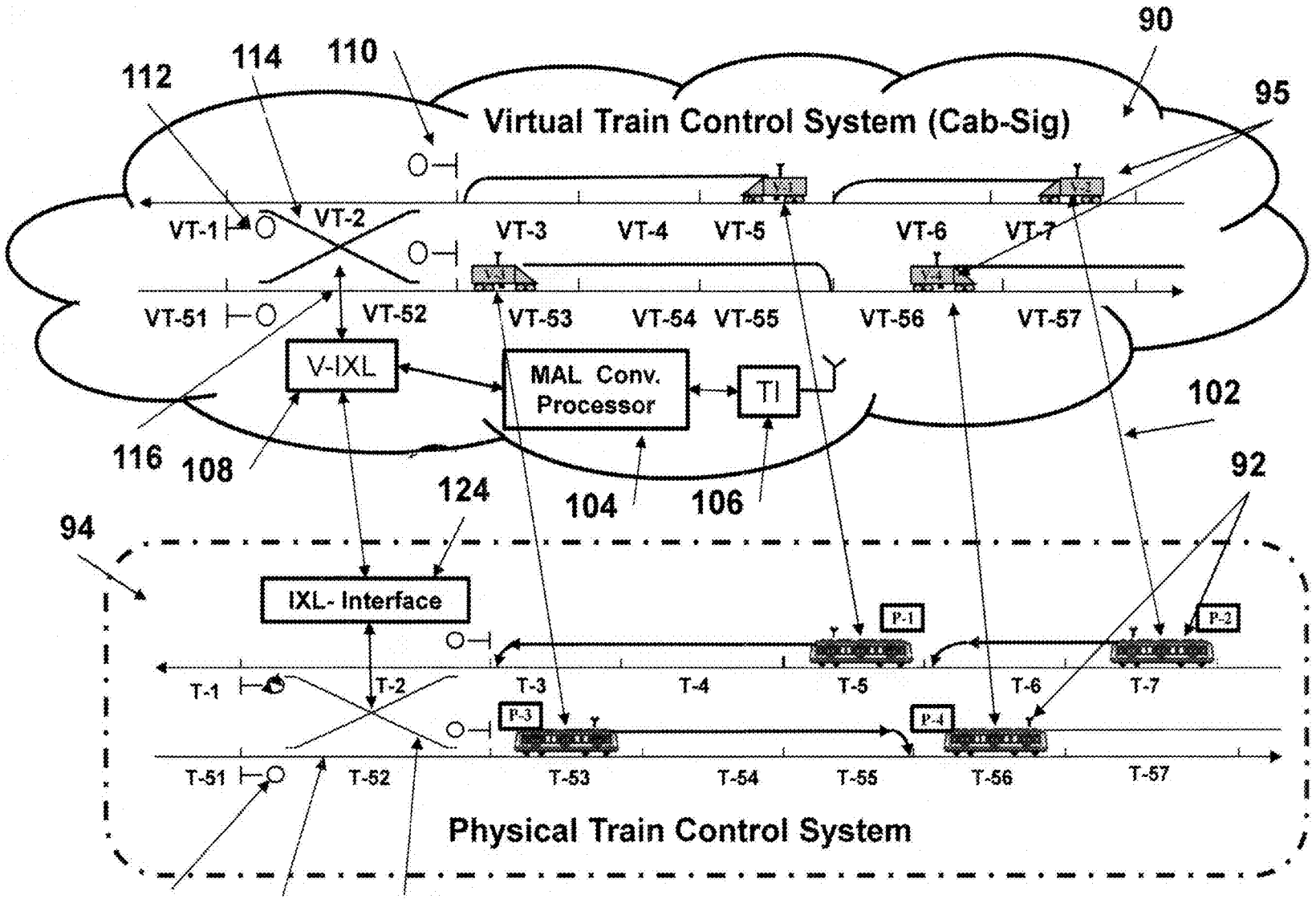
FIG. 10 shows the physical and virtual parts of a train control system overlay that converts cab-signaling speed codes into corresponding movement authority limits, indicating communications between physical elements and logical (virtual) elements in accordance with the invention.

Referring now to the drawings where the illustrations are for the purpose of describing the first alternate embodiment of the invention and are not intended to limit the invention hereto, FIG. 10 shows the main physical elements of the cab-signaling installation and the logical elements for the overlay virtual system within the cloud computing environment. Both the physical cab-signaling system 94 and the overlay virtual train control system 90 have an identical track configuration and an identical number of trains operating in the territory. Further, the trains are shown within the same cab-signaling blocks at both the physical and virtual systems. In that respect, physical trains P-1, P-2, P-3 and P-4 92 correspond to virtual (logical) trains V-1, V-2, V-3 and V-4 95. Similarly, physical track side interlocking devices: train detection blocks 120, switch control equipment 122, and wayside signals 118 correspond to the virtual (logical) interlocking devices: train detection blocks 116, switch control equipment 114, and wayside signals 110. The virtual train control system also includes the MAL conversion processor application platform MCP 104, which interface with the virtual trains 95 through a train interface module 106. As disclosed above, the MCP 104 includes a data base that stores information related to track topography (curves, grades, super elevation, etc.), locations and types of signal equipment on the track, including transponders, civil speed limits, cab-signaling blocks and their boundaries, and speed code charts that indicate the cab-signaling speed codes for each block for various traffic conditions (i.e. the block ahead where an obstacle is located). In addition, the virtual train control installation includes the interlocking control application platform V-IXL 108. The physical train control system includes the interlocking interface module 124.

Figure 11:
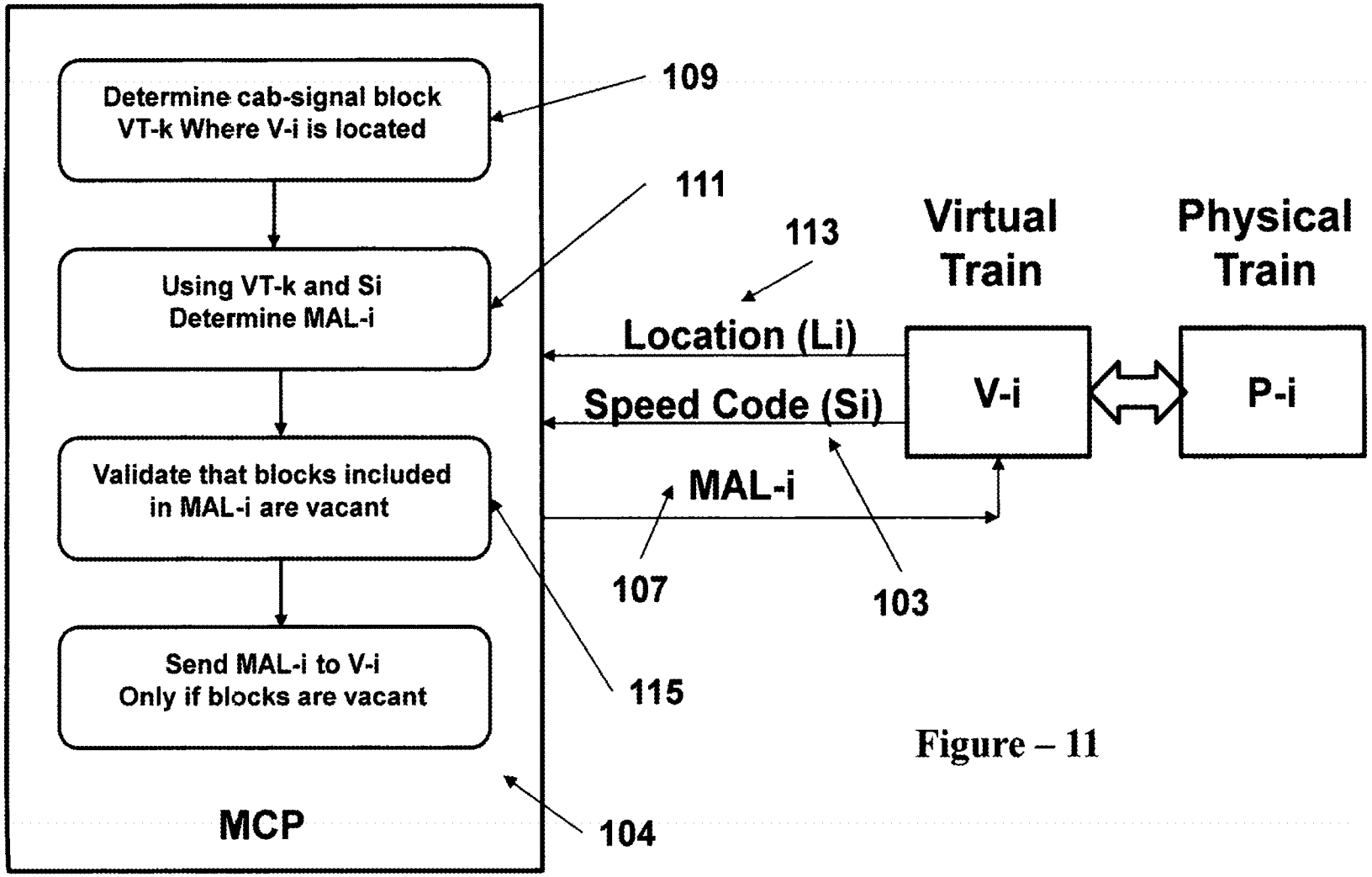
FIG. 11 shows the process used by the MAL Conversion Processor (MCP) to convert cab-signaling speed codes into corresponding movement authority limits.

FIG. 11 shows the general process proposed by the first alternate embodiment to convert cab-signaling speed codes 103 to corresponding movement authority limits 107. The prior art (U.S. Pat. No. 8,200,380) describes two main steps to convert cab-signaling speed codes to movement authority limits. The first step is to identify the cab-signaling block VT-k where a train V-i is located 109 using physical train location 113 (as calculated by the independent train location determination subsystem), and the cab-signaling block boundaries (stored in the data base of the MCP 104). The second step is to convert the cab-signaling speed code Si received from the physical train into a movement authority limit MAL-i based on the block where the train is located VT-k and the traffic condition corresponding to said cab-signaling speed code 111.

The MCP 104 of the first alternate embodiment implements the added safety function of ensuring that no train is present within a block included in a movement authority limit MAL-i 115. The existing cab-signaling installation employs vital logic, which ensures that a cab-signaling speed code is generated only if the associated control line is clear. However, under very rare conditions, one of the cab-signaling detection blocks can fail to detect a train, resulting in a false clear, or the generation of a false cab-signaling speed code.

Figure 12:
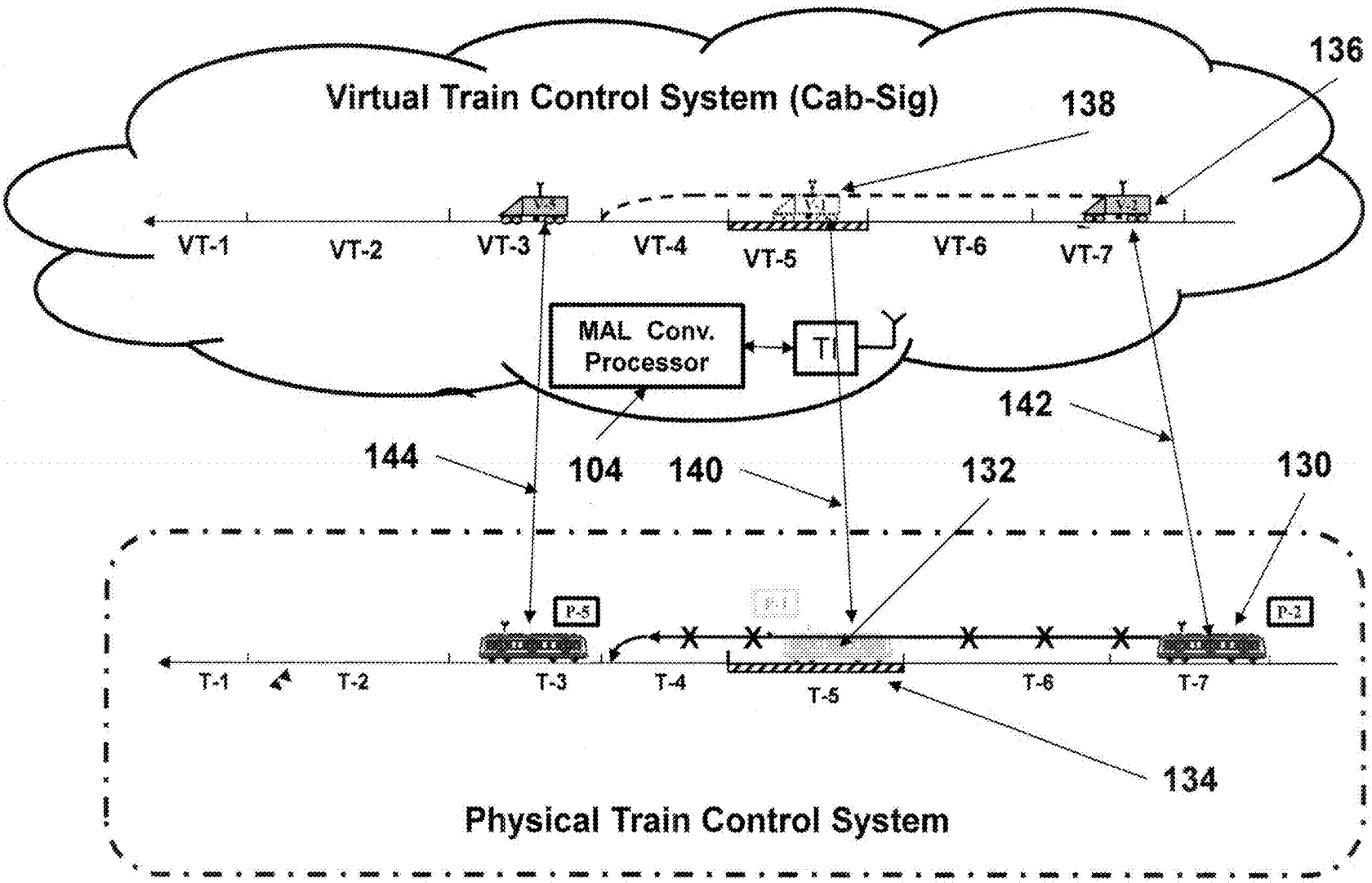
FIG. 12 demonstrates an operational scenario, wherein a physical train detection block fails to detect a train.

FIG. 12 demonstrates such rare condition (operational scenario) when a detection block fails to detect a train, and how the first alternate embodiment mitigates the safety risk associated with such unsafe failure. In the shown example, detection block T-5 134 fails to detect train P-1 132. In the absence of any mitigation provision, train P-1 132 will be invisible to the cab-signaling installation, and as such the cab-signaling system will generate a speed code to train P-2 130 that will place it on a collision course with train P-1 132. Pursuant to the design requirements of the first alternate embodiment, physical trains P-2 130 & P-1 132 communicate 142 & 140 their locations to corresponding virtual trains V-2 136 & V-1 138. In addition, physical train P-2 130 communicates 142 its speed code to virtual train V-2 136. The MCP 104 will then convert the speed code received from physical train P-2 130 into a corresponding movement authority limit. As shown in FIG. 11, the MCP 104 will then validate that the detection blocks included in the movement authority limit are vacant 115. Because train P-1 132 has communicated its location (that was determined independent of the failed detection block T-5 134) to virtual train V-1 138, the MCP 104 will prevent the transmission of a movement authority limit to physical train P-2 130, thus mitigating the safety risks associated with the failure of detection block T-5 134 to detect physical train P-1 132.

It should be noted that the MCP 104 relies on receiving the location of train P-1 132 through radio communication in order to perform the safety check 115 of validating that all blocks included in the movement authority limit are vacant. While such reliance is not considered fail-safe (if train P-1 132 fails to communicate with virtual train V-1 138, then the MCP 104 will not be able to detect the presence of train P-1 132 within detection block T-5 134), the probability of occurrence of such double failure condition is very low. This is the case because this double failure condition is based on an unlikely failure in detection block T-5 134 to detect train P-1 132, and at the same time a failure in the communication link between physical train P-1 132 and virtual train V-1 138. This would require two independent failures in two independent systems, affecting the same train, which is very unlikely.

Figure 13:
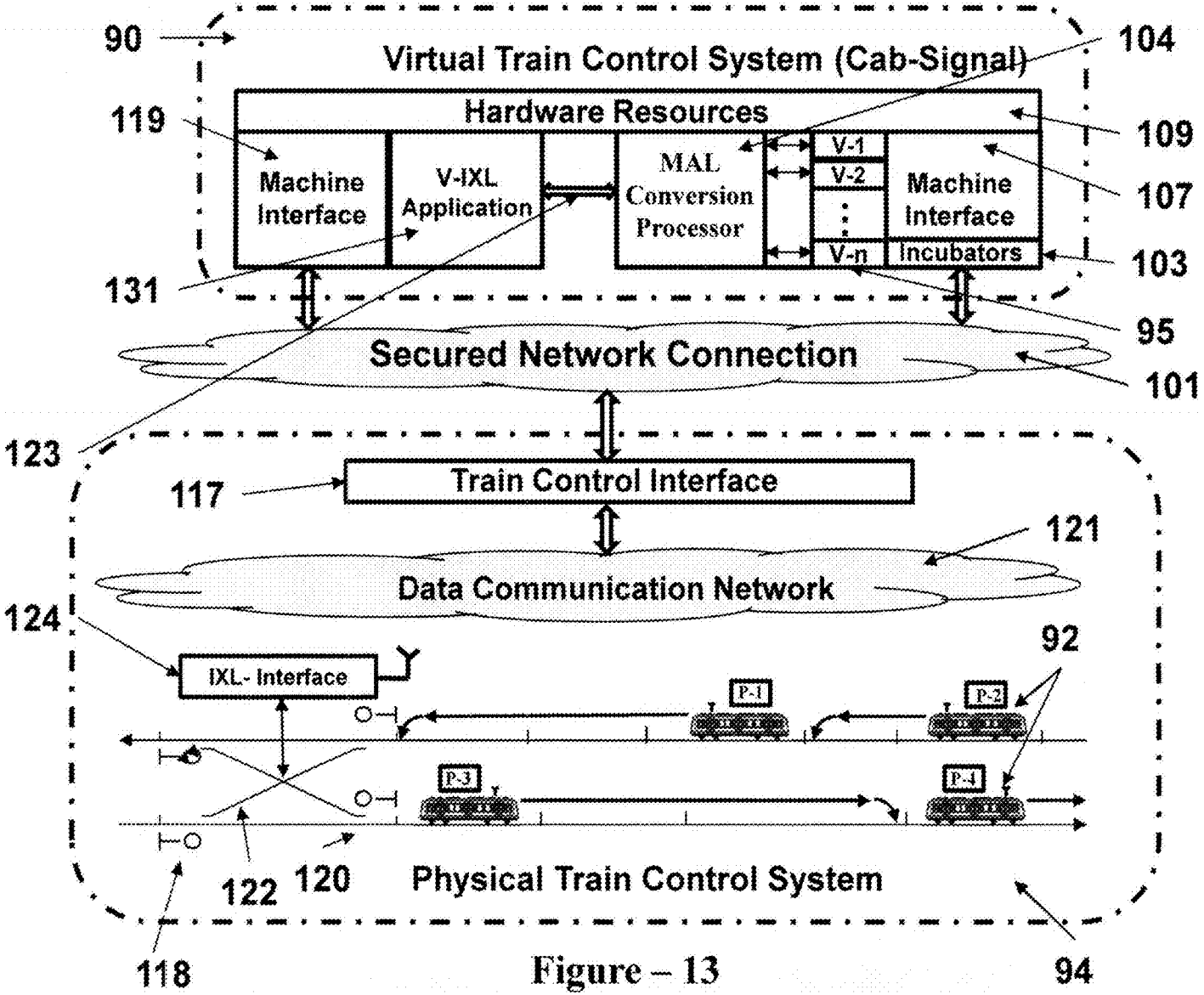
FIG. 13 shows a block diagram of an overlay to a cab-signaling system that provides distance-to-go operation, indicating the physical train control elements, and the cloud computing resource elements that provide the virtual train control system that converts cab-signaling speed codes to movement authority limits.

FIG. 13 shows a block diagram of an overlay train control implementation to enhance the safety and operational performance of a cab-signaling installation in a section of the railroad. The block diagram demonstrates how the enhanced train control system is partitioned into a modified physical cab-signaling installation 94 and a virtual train control system (Cab-Signal) 90. The modified physical cab-signaling installation 94 includes the original cab-signaling blocks and associated cab-signaling equipment, a train control interface 117, a data communication network 121, an interlocking interface module 124, new onboard train control computers (for trains P-1, P-2, P-3 & P-4) 92, and trackside interlocking devices: train detection blocks 120, switch control equipment 122 and wayside signals 118. The virtual train control system 90 includes the hardware computing resources 109 for the various train control application platforms, including the MAL Conversion Processor MCP application platform 104, the solid state application platform 131, and the application platform that emulates the onboard train control computers 95. Since the number of trains operating in the territory can vary, the virtual train control system provides a plurality (n) of computing modules 95 that emulate the onboard train control computers. Therefore, the maximum number of trains that can operate in this section of the railroad is limited to n.

Figure 14:
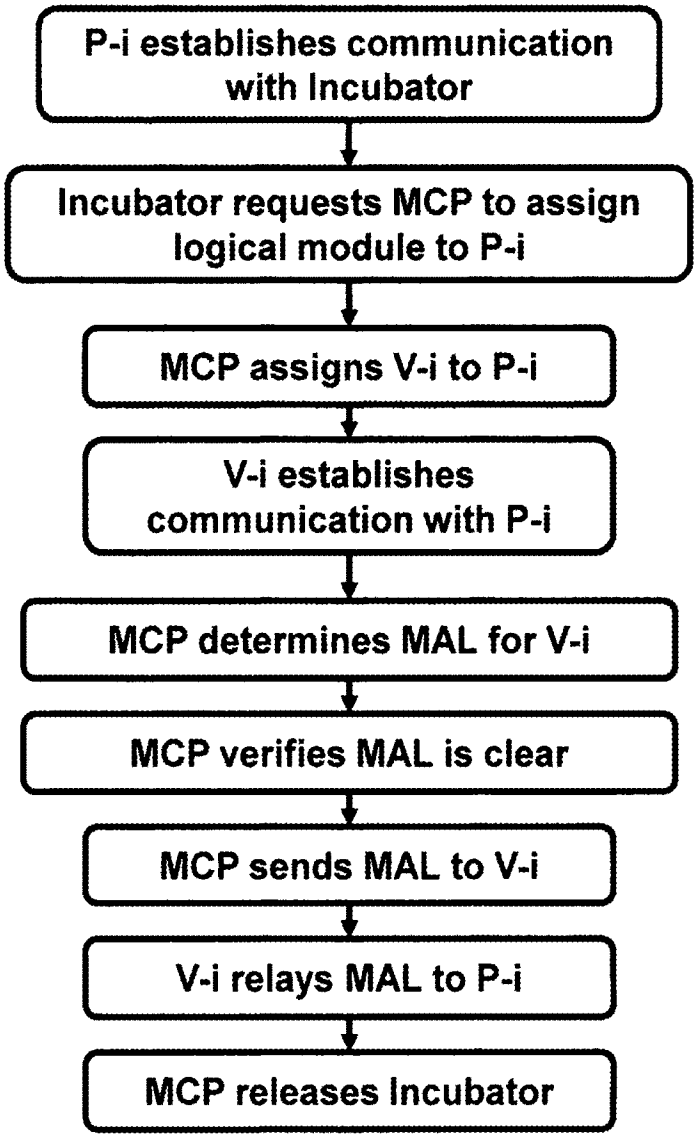
FIG. 14 shows the steps in the process to assign and initialize a virtual train for distance-to-go operation in the cloud computing environment associated with a cab-signaling installation.

The virtual train control system 90 also includes a plurality of logical elements or modules 103 that act as incubators to initialize a new train detected in the physical installation into the virtual train control system. This initialization process is not applicable to trains moving from adjacent sections of the railroad into this section. Those train are tracked by the system, and move from one section into an adjacent section (in both physical and virtual environments) using a transition process. Rather, the incubator process is intended to initialize a physical train when it is first detected in the train control installation. As a new physical train (P-i) is detected in the section, it is necessary to establish a corresponding virtual train (V-i) in the virtual train control system. For the first alternate embodiment, which implements Cab-signaling technology, the detection is through radio communication. The initial frequency or radio channel assigned to the train is designed and/or configured to establish communication with one of the plurality of incubators 103. Upon establishing such communication, the incubator requests the MCP 104 to assign a virtual train to physical train P-i, and initialize the virtual train into the virtual system 90. The initialization process is coordinated with the MCP task to determine the cab-signaling block VT-k where V-i is located 109 (FIG. 11). Upon receiving a request from the incubator, the MCP assigns an available logical module (virtual train) V-i to P-i. Then upon establishing communication between P-i & V-i, the MCP 104 will determine a movement authority limit to V-i, which in turn will relay the movement authority to P-i. After the completion of this initialization process for train P-i, the MCP releases the incubator so that the process is repeated when a new train is detected in the railroad section. The above described initialization process is shown in FIG. 14.

Figure 15:
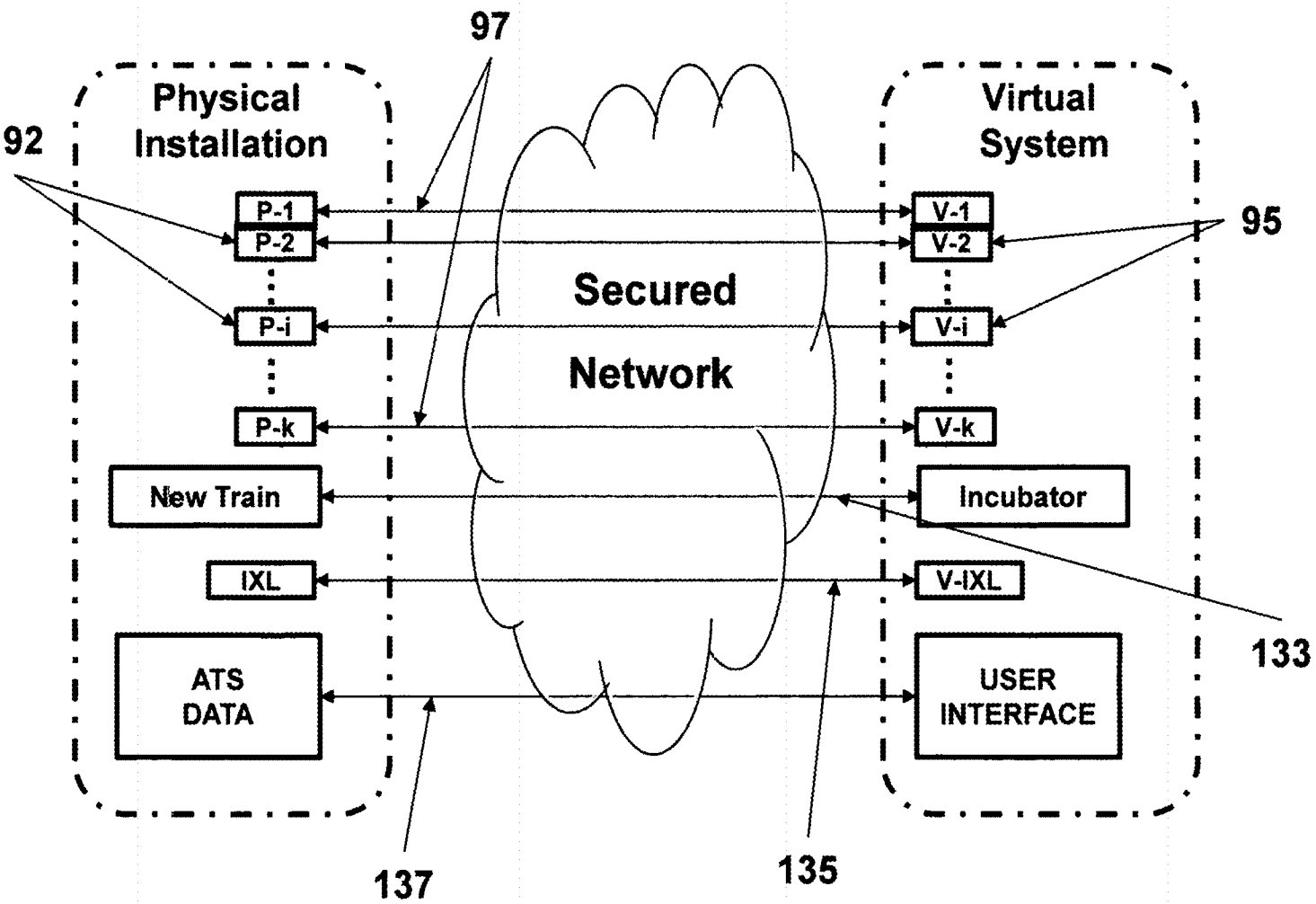
FIG. 15 shows the main communication channels required between the physical installation and the virtual train control system for a cab-signaling overlay implementation to convert cab-signaling operation to distance-to-go operation.
Figure 16:
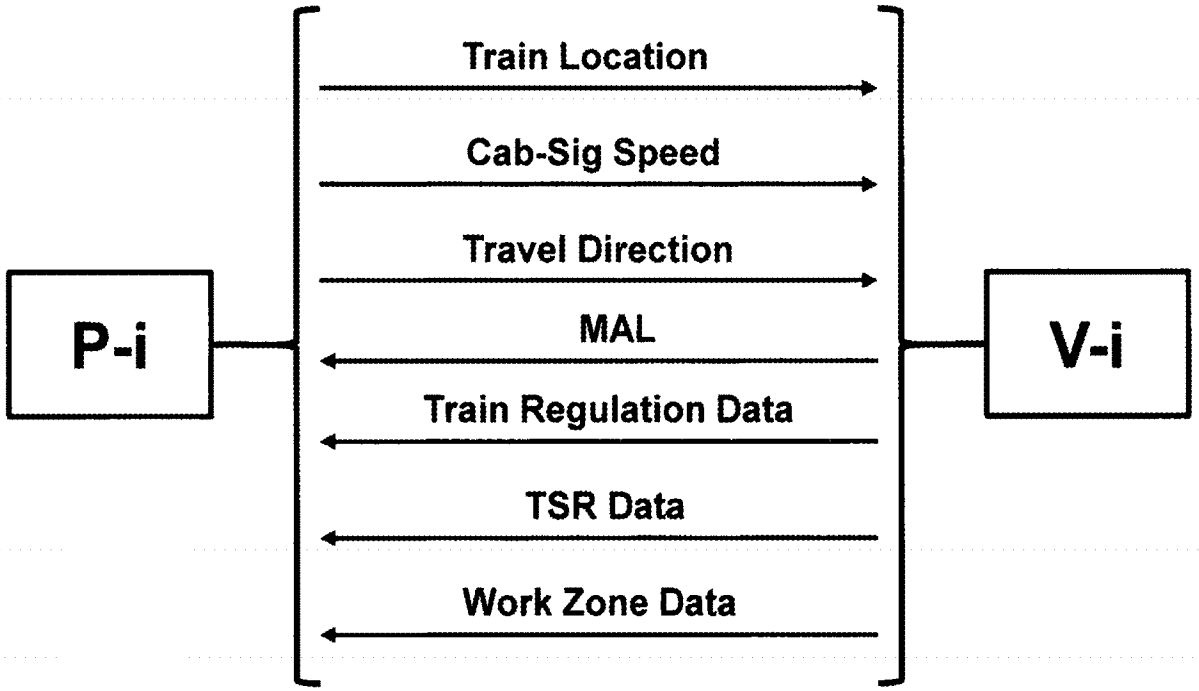
FIG. 16 shows the main data and information exchanged between a physical train controller and a corresponding logical element (virtual train) in the cloud computing environment for a cab-signaling overlay implementation to convert cab-signaling operation to distance-to-go operation.

The virtual train control system (Cab-Signal) 90 also includes machine interfaces 107 & 119 that represent the demarcation points for communications with the physical train control installation 94 through a secure network connection 101. In that respect, FIG. 15 shows the main communication channels between the physical installation and the virtual train control systems for an overlay to a cab-signaling implementation as per the first alternate embodiment. In general, two way communications 97 is required between physical trains 92 and virtual (logical) trains 95, between new detected trains and incubators 133, between physical and virtual interlocking elements 135, and between the ATS of the physical installation and the user interface at the virtual train control system 137. FIG. 16 shows the various status information and control data exchanged between physical train P-i and corresponding virtual train V-i. It should be noted that the specific status information and control data shown in FIG. 16 are set forth for the purpose of describing the first alternate embodiment, and are not intended to limit the invention hereto. As would be understood by a person of ordinary skills in the art, additional or different status information and control data may be exchanged between a physical train and a corresponding virtual train depending on the requirements and design for the cab-signaling overlay system.

Similar to the preferred embodiment, the V-IXL application platform 131 could be based on an interlocking rules approach or could employ Boolean equations to implement signal control logic. In addition, the specific trackside interlocking equipment can vary from system to system and from location to location. As such, the specific status information and control data exchanged between the physical installation and the virtual system will vary from installation to installation All such variations described above are within the scope of this invention. With respect to the interfaces 123 between the V-IXL application platform 131 and the MCP 104, the V-IXL provides the MCP with the status of interlocking equipment, including switch positions and signal status. In addition, as shown in FIG. 15, the MCP receives data related to temporary speed restrictions and work zones from a user interface that communicates with an ATS subsystem 137.

With respect to the main operation of the enhanced cab-signaling system described in FIGS. 10 & 13, each physical train P-i 92 receives a cab-signaling speed code from the existing cab-signaling installation. In addition, each physical train P-i determines its own location using an independent location determination subsystem. Each physical train P-i then transmits its location and cab-signaling speed to the corresponding virtual (logical) train V-i 95 in the virtual train control system. In turn, each virtual train V-i 95 communicates its location and cab-signaling speed code to the MCP 104. Using a data base that stores data related to the cab-signaling blocks, the MCP 104 converts cab-signaling speed codes into corresponding movement authority limits, and communicates the calculated movement authority limits to the virtual (logical) trains 95. Each virtual train 95 then sends the received movement authority limit to the corresponding physical train 92. Upon receiving a movement authority limit, a physical train P-i generates a stopping profile from its current location to the end of the received movement authority limit, using track topography data stored in its vital on-board data base, and taking into account any civil speed limits reflected in the data base. The onboard computer then ensures that the physical train does not exceed the speed and the movement authority limit defined by the stopping profile. As the physical trains move on the track, they update their locations and cab-signaling speed codes to the corresponding virtual trains, which report their updated information to the MCP. In turn the MCP updates the movement authority limits to the various trains operating on the system, and the cycle repeats. For movement through an interlocking route, the MCP ensures that any generated movement authority limit reflects switch positions within the interlocking, as well as the statuses of the wayside signals as they relate to the cab-signaling speed codes. For example, the MCP will resolve any uncertainty related to positive stop requirement by ensuring that a movement authority limit is not provided through an interlocking signal that displays a "stop" aspect.

Similar to the preferred embodiment, the logical modules (virtual trains) could be used to implement additional train control functions that can be exercised for a particular train or a group of trains if service conditions require it. The logical modules can also implement temporary train control functions that could limit the functions available onboard specific trains. In addition, in the case of driverless operation, and if a physical train is disabled or fails in revenue service, the corresponding logical module could be interfaced with a train simulator that has provisions for manual train controls. The train simulator could then be used to remotely operate the disabled or failed train up to the next station, where the train could be taken out of service.

With respect to failure modes management for the first alternate embodiment, the proposed architecture has the advantage of providing an almost fault free cloud computing environment for an overlay that enhances the safety and operational flexibility of an existing cab-signaling installation. As such, a total failure of a Mal Conversion Processor or a solid state interlocking control device is very unlikely. Potential failures of the installation include a loss of communication between a physical train and a virtual train, a loss of communication between physical interlocking elements and corresponding virtual elements, or a total loss of communication within a section of the railroad. If a physical train loses communication with its corresponding virtual train, the physical train can be operated in a cab-signaling mode of operation using cab-signaling speed codes. In such a case, the affected train will lose the safety and operational benefits provided by this overlay installation, but the train will continue to operate under cab-signaling protection. The corresponding virtual train will lose its movement authority limit, and its location will not be updated via information received from the corresponding physical train. However, the MCP can still track the physical train on a non-vital basis using data received from the ATS subsystem, or based on speed codes received from a following physical train. It should be noted that when a virtual train loses communication with a physical train, it remains assigned to the physical train until communication is re-established, or the virtual train is released for reassignment by the system administrator (case when the physical train is taken out of service or leaves the section of the railroad).

Similarly, if communication is lost between the physical interlocking elements and the corresponding virtual elements, the physical elements will revert to the safe state (wayside signals will display a "stop" aspect, and switches will remain in the last position). Within the virtual train control system, all affected virtual train detection blocks will reflect an "occupied" status, all affected virtual switches will reflect "out of correspondence," and all affected virtual signals will reflect "stop" aspect. The MCP will then determine the impact of the loss of communications on any issued movement authority limits, and will cancel all movement authorities affected by this loss of communications. In turn, affected virtual trains will relay the cancellation of movement authorities to corresponding physical trains, which will then operate in cab-signaling mode.

In the unlikely event of a total loss of communications between the physical train control installation and the virtual train control system, all affected physical trains will operate in cab-signaling mode using cab-signaling speed codes. Also, all affected wayside signals will display a "stop" aspect. In the virtual system, all affected virtual (logical) trains will lose their movement authority limits, and all affected virtual interlocking devices will assume a safe state. Upon reestablishing communications, the system and all virtual trains operating in the section need to be initialized before the enhanced train operation can resume.

Figure 8:
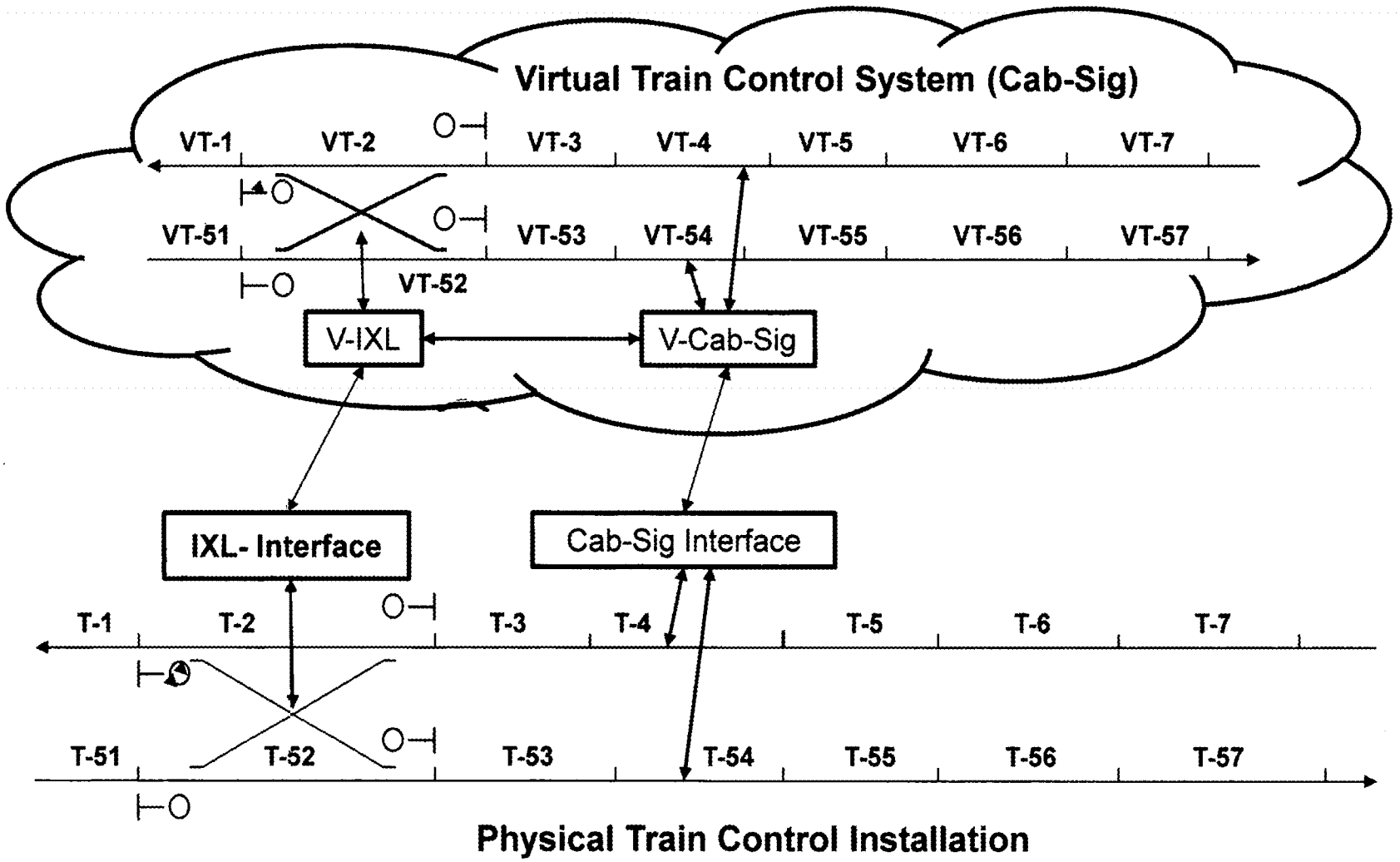
FIG. 8 shows the physical and virtual parts of a cab-signaling implementation, indicating communications between physical elements and logical (virtual) elements for an architecture, wherein speed codes are injected into the rails, in accordance with the invention.

As indicated above, virtualization and cloud computing environment could be used to provide a new train control system based on cab-signaling technology. Two alternate design approaches are presented. In FIG. 8, the physical train control installation includes the physical cab-signaling blocks, and a cab-signaling interface module that provides interconnections to inject cab-signaling speed codes into the rails. The virtual train control system (Cab-Signal) includes a virtual cab-signaling application platform that provides the vital logic to generate cab-signaling speed codes. The physical cab-signaling train detection blocks send the block occupancy information to corresponding logical (virtual) elements at the virtual train control system. In turn, these logical elements interface with the virtual cab-signaling application platform and provide the statuses of the physical train detection blocks. The cab-signaling application platform processes the statuses of the train detection blocks to generate a cab-signaling speed code for each block. The speed codes are communicated to the cab-signaling interface module in the physical installation, which in turn transmits them to the various blocks.

Figure 9:
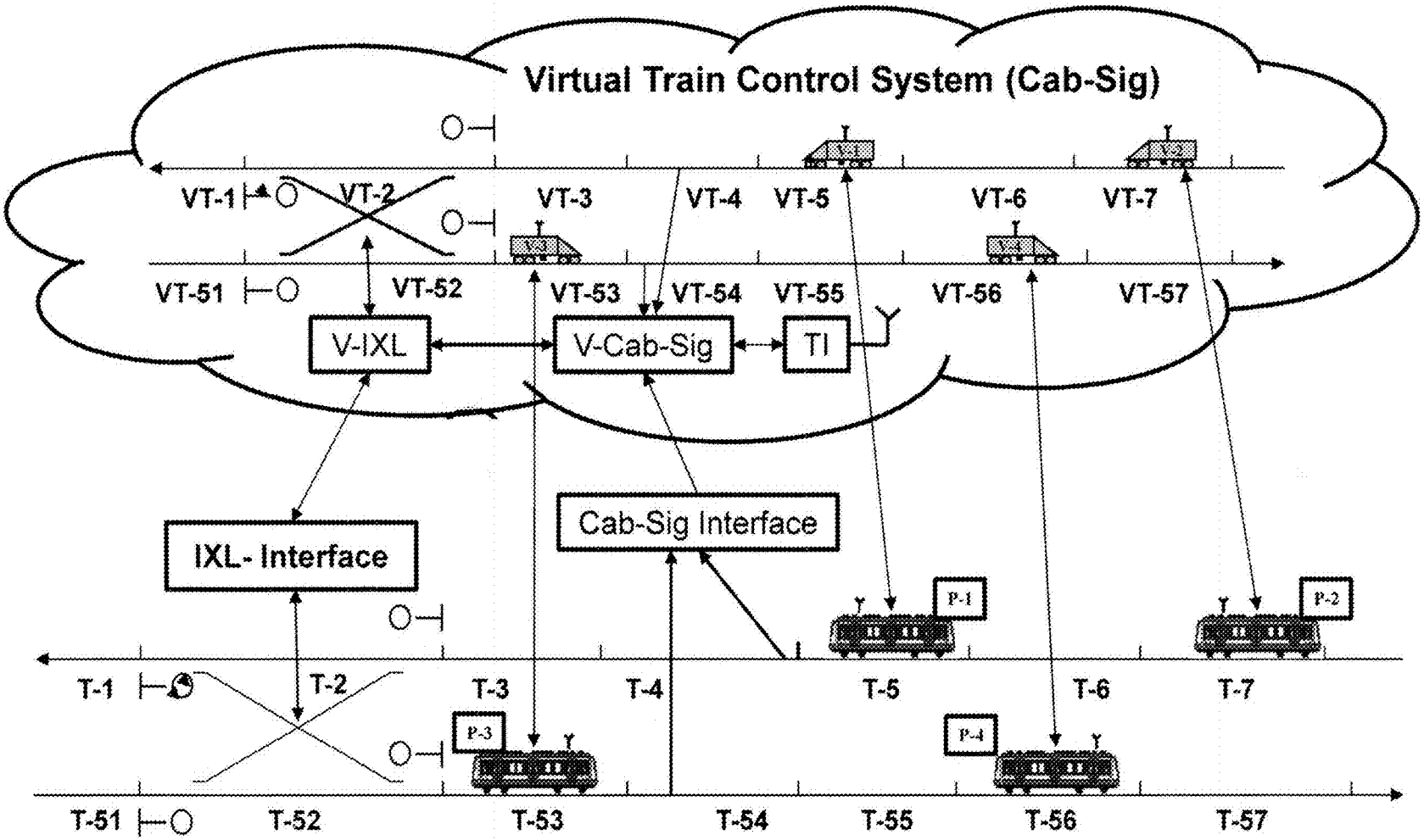
FIG. 9 shows the physical and virtual parts of a cab-signaling implementation, indicating communications between physical elements and logical (virtual) elements for an architecture, wherein speed codes are transmitted to trains over a wireless network, in accordance with the invention.

FIG. 9 demonstrates an alternate design to provide a new train control system based on cab-signaling technology. Under this architecture, speed codes are not injected into the rails of cab-signaling blocks, rather speed codes are communicated from logical (virtual) trains in the virtual train control system (cloud computing environment) to corresponding physical trains via a wireless data network. Also, physical trains have on-board equipment to determine train location independent of train detection blocks. The physical trains communicate their location to corresponding virtual (logical) trains. In turn, the virtual trains interface with the virtual cab-signaling application platform to provide the locations of the physical trains. Similar to the system described in FIG. 8, the virtual cab-signaling application platform calculates cab-signaling speed codes based on statuses of physical train detection blocks. The virtual cab-signaling application platform then transmits the generated speed codes to the virtual trains based on the location information received from the physical trains. In turn the virtual trains send the speed codes to associated physical trains.

As would be understood by those skilled in the art, different alternate embodiments can be provided to implement or enhance a cab-signaling installation using the concepts described herein. For example, the interlocking application platform could be implemented as part of the physical installation. Also, alternate cloud computing architecture could be used to implement the virtual train control system. Further, a different communications configuration could be used to exchange status information and control data between the physical cab-signaling installation and the virtual train control system. It is also to be understood that the foregoing detailed description of the first alternate embodiment has been given for clearness of understanding only, and is intended to be exemplary of the invention while not limiting the invention to the exact embodiments shown.

Description of a Second Alternate Embodiment

The objectives of the invention could also be achieved by a second alternate embodiment that provides a train control installation, which employs fixed block, wayside signals technology. This embodiment takes advantage of cloud computing and virtualization in order to provide an auxiliary wayside signal (AWS) system that operates either as a standalone installation or in conjunction with communications based train control (CBTC). A standalone AWS installation provides signal protection for unequipped trains operating in manual mode. The AWS installation can also provide distance-to-go operation for trains equipped with onboard CBTC equipment, and will provide shorter headways for such trains. When used in conjunction with either a CBTC system, or equipped CBTC trains, the combined CBTC & AWS installation will support mixed fleet operation, and will provide signal protection for both equipped and unequipped trains. As such, the main objective of this implementation is to provide a cost effective and functionally enhanced auxiliary wayside signal installation based on fixed block wayside technology. The enhanced AWS installation can provide positive stop enforcement, continuous over speed protection, increased track capacity, protection against wrong-side track circuit failure (false clear), enforcement of civil speed limits and temporary speed restrictions, protection of work zones and a distance-to-go operation (compatible with CBTC).

Similar to the preferred embodiment, the train control installation for the second alternate embodiment is partitioned into two main parts. The first part comprises the physical AWS installation that includes wayside signal equipment, a wireless data network that provides two-way communications between equipped physical trains and wayside interface modules, a two-way communications between wayside signal locations and signal interface units, and train control devices on-board equipped physical trains that provide CBTC type operation (i.e. distance-to-go operation). It should be noted that unequipped trains can also operate in a manual mode with wayside signal protection in this section of the railroad. Equipped trains employ an independent train location determination subsystem, which could be implemented using transponder based technology, wherein transponders are installed on the track bed to provide reference locations. Between transponders, trains continue to compute their locations and speeds using on-board odometry devices. The train location determination subsystem could also be based on global position satellite (GPS) technology, FIG. 8 loops, triangulation of radio signals, etc.

The second part of the installation is defined as the virtual train control system, is implemented in a cloud computing environment, and includes the processing resources and associated train control application platforms that provide the safety critical train control functions necessary to achieve the objectives of the second alternate embodiment. Further, the second part includes a virtualization of physical components provided in the first part, including virtual signal locations and virtual trains that correspond to physical equipped trains. These virtual components act as logical elements that interact with the train application platforms to provide a complete train control system in the cloud environment. The logical elements are also used to provide the interfaces between the physical installation and the virtual train control system. As such, each of the logical (virtual) elements of the virtual train control system communicates with a corresponding physical element in the train control installation. For example, a virtual on-board train control module (or computer) communicates with the on-board train control module or computer for the corresponding equipped physical train. For the second alternate embodiment, a virtual on-board train control computer receives train location information from, and sends movement authority limit data to, the on-board train control computer for the corresponding equipped physical train. Also, a virtual signal application processor communicates with a signal interface unit in the physical train control system to exchange data that include the statuses of signal equipment associated with wayside signal locations, and the controls for said signal equipment. In effect, and since the virtual signal locations act as interface modules for the corresponding physical signal locations, each physical signal location sends the statuses of associated signal equipment to, and receives control data from, the corresponding virtual signal location.

The virtual train control system includes a virtual signal application processor (VSAP) that provides the control logic for the wayside signal locations. The virtual train control system also comprises a MAL Conversion Processor (MCP), which includes a data base that stores information related to track topography (curves, grades, super elevation, etc.), locations and types of signal equipment on the track, including transponders, civil speed limits, fixed blocks and their boundaries, and control lines data for wayside signals. The virtual train control system further includes logical elements that represent and emulates the operation of on-board computers located at physical trains, and physical trackside signal equipment. The cloud computing provides a secure, highly available (almost fault free), versatile, and maintenance free (for the transit operator) environment to implement an auxiliary wayside signal installation.

A control line for a wayside signal identifies the train detection blocks that must be vacant before the signal can display a "clear" aspect. For the second alternate embodiment, the fixed block signal installation is based on a three-aspect operation that include a "red" aspect for stop, a "yellow" aspect for proceed with caution, and a "green" aspect for proceed at maximum allowable speed. As such, a "clear" aspect is defined as either a "yellow" or a "green" aspect. Further, a signal location includes an automatic train stop that enforces a "red" aspect. The control line normally includes at least one overlap block that provides sufficient breaking distance for a train to stop if it is "tripped" by the automatic train stop when travelling at maximum attainable speed. The term "tripped" means that the brake system on-board the train was activated by the automatic train stop on the wayside.

The MCP converts a clear signal aspect ("yellow" or "green") for an approaching equipped train into a movement authority limit (MAL). Because an equipped train is continuously controlled by the on-board equipment (that also provides continuous over-speed protection), the limit of the movement authority can extend through the entire length of the control line, including the overlap block or blocks. As such, a MAL associated with a "yellow" signal extends from the location of the signal past at least one stop ("red") aspect. Similarly, a MAL associated with a "green" signal extends from the location of the signal, through the "yellow" signal ahead, and past at least one "stop" aspect. This necessitates overriding the wayside signals and associated train stops at the signal locations included within the movement authority limit. For the second alternate embodiment, each signal location includes an additional aspect that displays an "X" to indicate to an approaching equipped train that the conventional wayside signal indication (red, yellow or green) has been overridden.

The MCP communicates the MAL to the virtual signal application processor that provides the control logic for the wayside signal locations. In turn, the VSAP activates the "X" aspect at the signal locations that are located within the MAL, and ensures that the automatic train stops at these locations are in the clear position. The VSAP will then send status data that reflects the clear position of these automatic train stops to the MCP. Upon receiving the automatic stop status data from the virtual signal application processor, the MCP transmits the MAL to the approaching virtual train, which in turn transmits the MAL to the associated physical train. The timing of transmitting a MAL to an approaching train takes into consideration the location of the approaching train relative to the wayside signal, and ensures that there is no short train between the approaching train and the signal at the time the MAL is transmitted to the train. The MCP also checks the integrity of the fixed train detection blocks by ensuring that there are no physical trains located within the boundaries of a generated MAL. It should be noted that the use of an "X" aspect to override a wayside signal location is a design choice. As would be appreciated by a person with ordinary skills in the art, a different aspect could be used to provide the override indication. For example, a flashing green aspect could be generated at a signal for an approaching equipped train with a MAL that overlaps the signal.

It should also be noted that the use of a centralized MCP is a design choice. As would be understood by a person with ordinary skills in the art, the MCP functions could be implemented at each of the logical elements that represent virtual trains. In such distributed architecture, each virtual (logical) train converts a clear signal aspect ("yellow" or "green") of a signal ahead into a corresponding movement authority limit (MAL). Each virtual train then communicates the MAL to the virtual signal application processor that provides the control logic for the wayside signal locations. In turn, the VSAP activates the "X" aspect at the signal locations that are located within the MAL, and ensures that the automatic train stops at these locations are in the clear position. The virtual signal application processor will then send status data that reflects the clear position of these automatic train stops to the virtual train. Upon receiving the automatic stop status data from the VSAP, the virtual train will transmit the MAL to the associated physical train.

Figure 17:
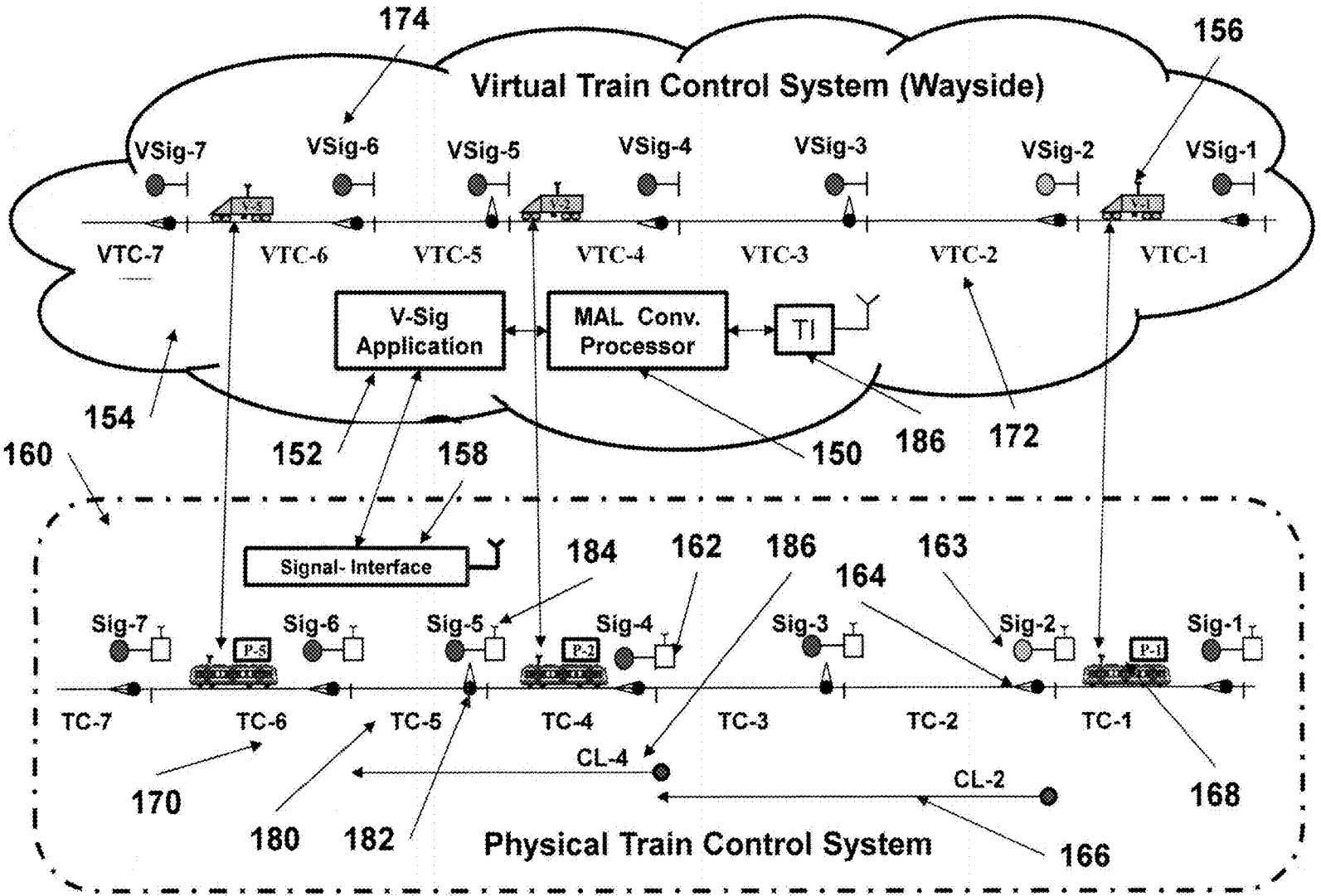
FIGS. 17 & 18 show the physical and virtual parts of a train control system that provides an auxiliary wayside signal system based on fixed block, wayside signaling technology, indicating communications between physical elements and logical (virtual) elements in accordance with the invention. The figures also show traditional manual operation, and distance-to-go operation based on the conversion of wayside signal aspects to movement authority limits.
Figure 18:
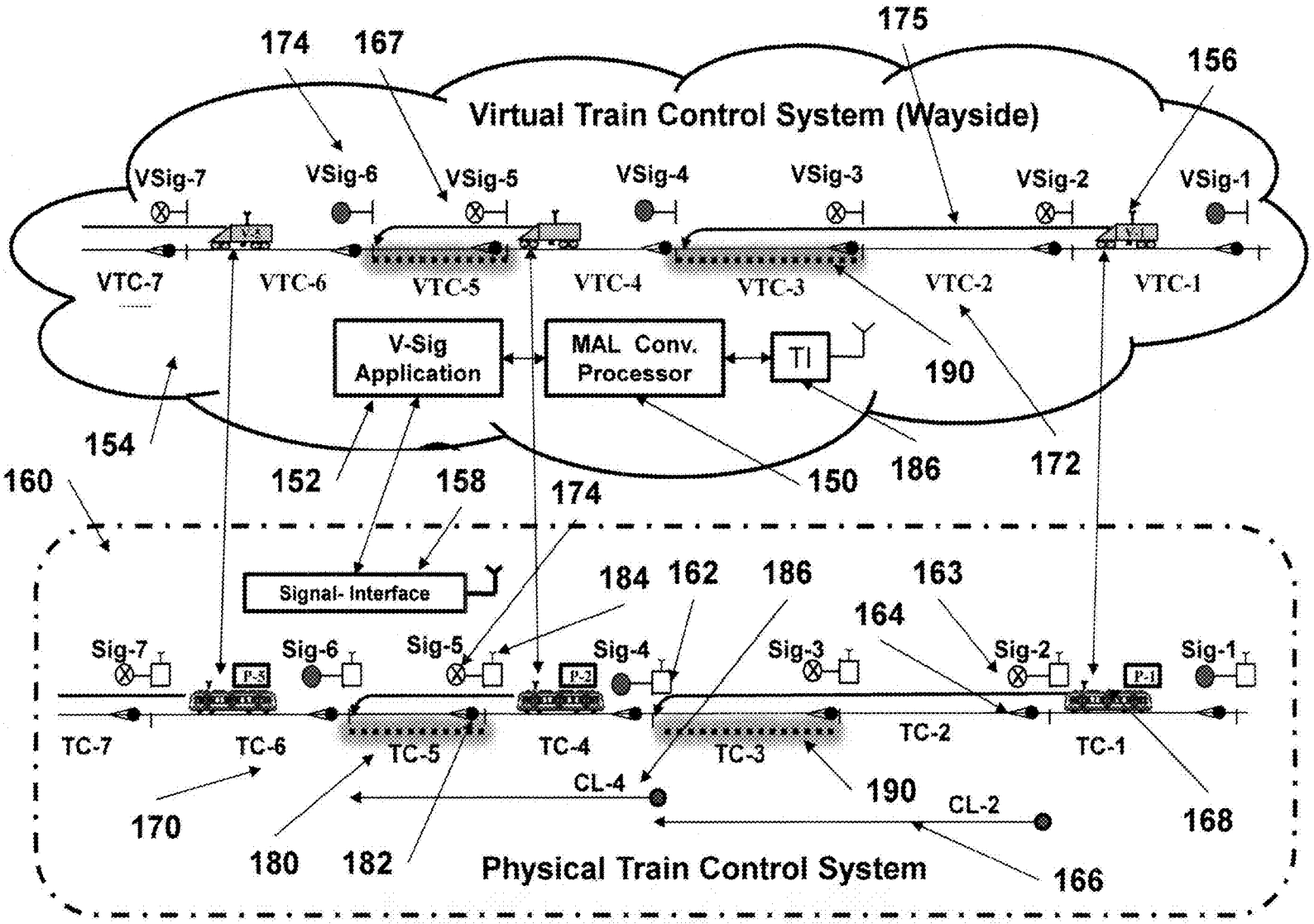

Referring now to the drawings where the illustrations are for the purpose of describing the second alternate embodiment of the invention and are not intended to limit the invention hereto, FIGS. 17 & 18 show the main physical elements of the AWS installation and the logical elements for the overlay virtual system within the cloud computing environment. Both the physical AWS system 160 and the overlay virtual train control system 154 have an identical track configuration and an identical number of trains operating in the territory. Further, the trains are shown within the same fixed blocks at both the physical and virtual systems. In that respect, physical trains P-1, P-2 and P-5 168 correspond to virtual (logical) trains V-1, V-2 and V-5 156. Similarly, physical train detection blocks 170, wayside signals 184, and wayside automatic train stops 164 correspond to the virtual (logical) elements that include train detection blocks 172, signals 174, and automatic train stops 173. The virtual train control system also includes a virtual signal application processor 152 that provides the control logic for the wayside signals 174, the MAL conversion processor application platform (MCP) 150, which interfaces with the virtual trains 156 through a train interface module 186. As disclosed above, the MCP 150 includes a data base that stores information related to track topography (curves, grades, super elevation, etc.), locations and types of signal equipment on the track, including transponders, civil speed limits, fixed train detection blocks 180 and their boundaries, and control lines for the wayside signals 166 & 186. An interface between the MCP 150 and the virtual signal application platform 152 allows for exchange of data required to override wayside signals 174 and provide status of automatic train stops 182. The VSAP 152 also communicates with a signal interface module 158 within the physical train control installation to provide control data for the signal equipment at wayside signal locations 162, and to receive status data from the signal equipment.

Figure 19:
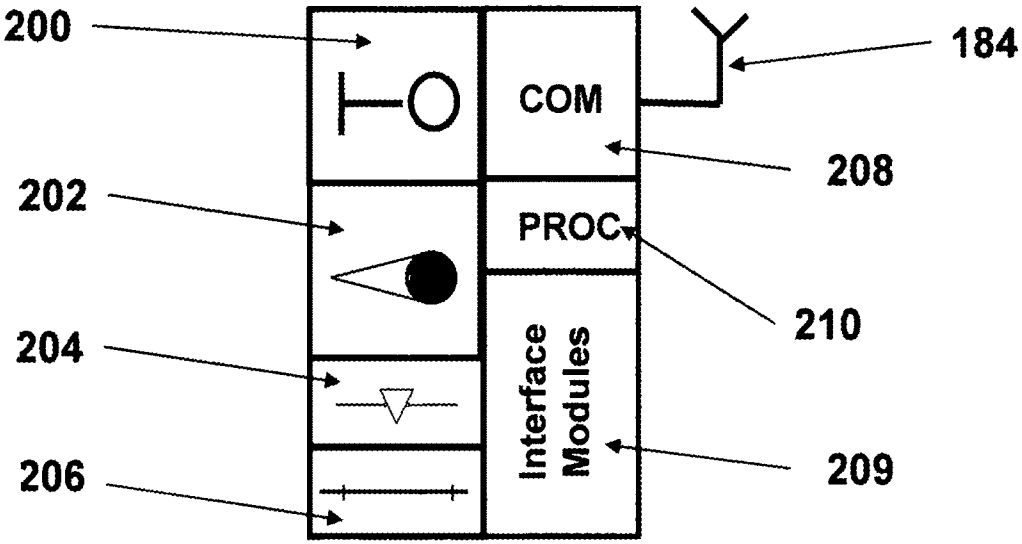
FIG. 19 shows the physical elements at a wayside signal location.

A typical signal location for the second alternate embodiment is shown in FIG. 19, and includes a signal head 200, an automatic mechanical train stop 202, with associated circuit controller 204 (that provides the status of the train stop), a fixed block train detection module 206, a radio communication module 208 with associated antenna 184, an interface module 209, related to fixed block train detection from the fixed block train detection module 206, as well as the status of the automatic train stop 202 from its associated circuit controller 204, via the radio communication module 208. The VSAP 152 then generates control data for the wayside signal locations 162 using the status data received from the various signal locations 162, control line information 166 & 186, and data received from the MCP 150. At each signal location 162, a processor module 210 processes received control data to activate the appropriate aspects at the signal head 200 and the automatic train stop 202. In the event of a failure, such as a loss of communication, the processor module 210 is programmed to enable trains to "key-by" the signal location. To use the "key-by" function, a train must proceed at a low speed (10 mph) into the block ahead of the signal, which will cause the automatic stop to drive to the clear position. Thus it allows the train to move past the red signal. The interface modules 209 include the necessary electrical circuits to interface with the signal equipment. It should be noted that it is a design choice to perform additional control logic at each signal location. For example, the processor 210 could be programmed to provide certain control and/or monitoring functions related to the associated signal equipment using data received from the VSAP 152. The monitoring functions could include detection of failure conditions and maintaining statistics related to maintenance activities.

It should also be noted that the use of radio communication 184 to interconnect the wayside locations 162 with signal interface unit 158 is set forth herein for the purpose of describing the second alternate embodiment, and is not intended to limit the invention hereto. As would be understood by a person with ordinary skills in the art, other means of communication could be used. For example, a data network based on fiber optic technology could be used to interconnect the wayside locations 162 with the signal interface unit 158.

FIG. 17 shows the wayside signal installation with manual train operation, wherein the aspects displayed at the various signal locations 163 are based on the control lines 166 & 186 and the locations of indicated trains 168. This manual operation is based on the use of unequipped trains, or equipped trains operating in manual mode. As such, no conversions of signal aspects to movement authority limits take place.

FIG. 18 shows the wayside signal installation of FIG. 17 with distance-to-go operation. During this type of operation, the MCP 150 converts wayside signal aspects 163 to corresponding movement authority limits 175 for approaching trains based on the control lines associated with wayside signals 166 & 186. Further, the VSAP 152 overrides wayside signals to display an "X" 174 for approaching equipped trains. As disclosed above, a movement authority limit 175 enables trains to operate closer together, thus reducing the operating headway. For example, under a distance-to-go operation, train P-1 168 is permitted to proceed past the red aspect of Sig-3 to the end of block TC-3. This represents a reduction in train separation 190 that is equal to the length of fixed block TC-3.

Figure 20:
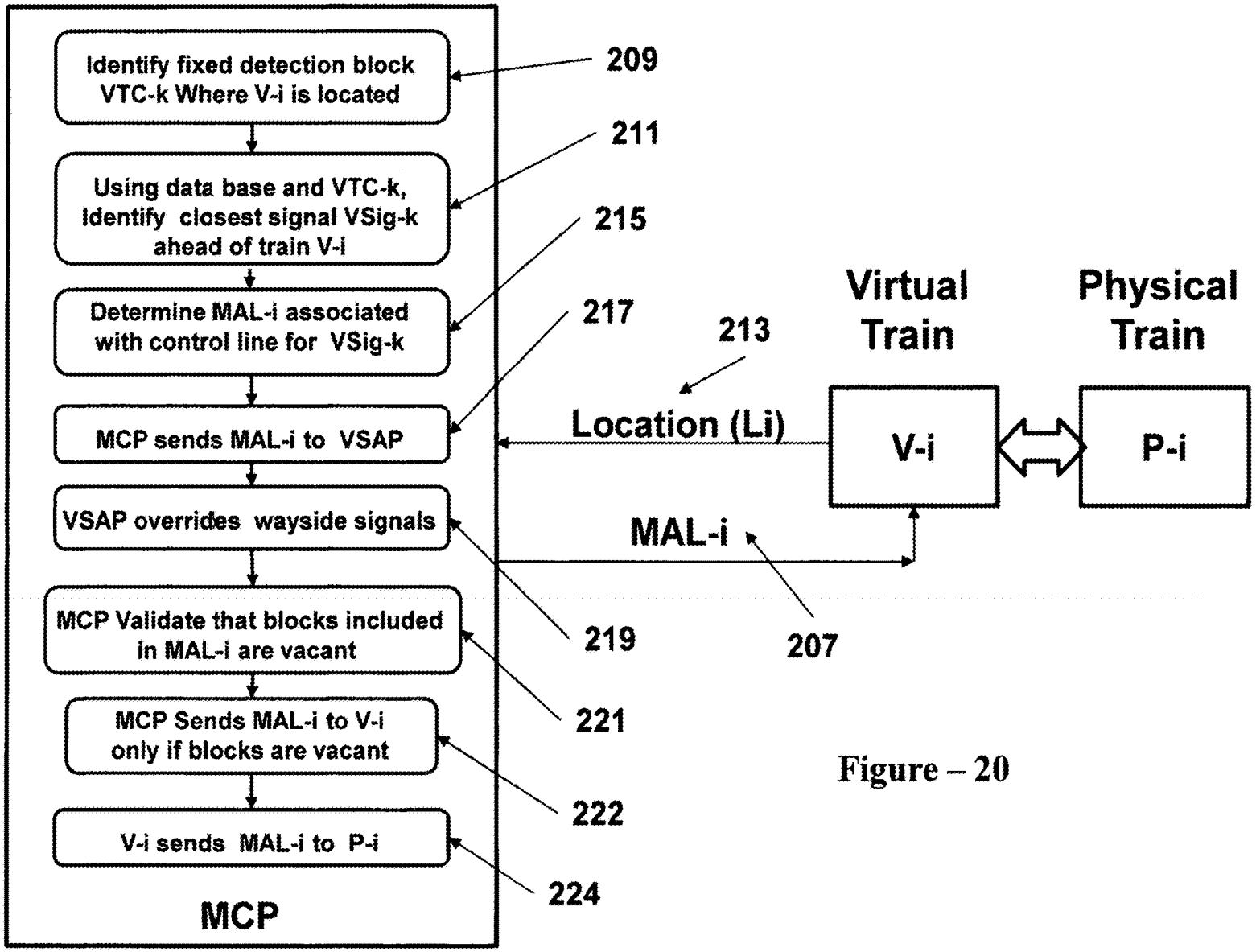
FIG. 20 shows the process used by the MAL Conversion Processor (MCP) to convert wayside signal aspects into corresponding movement authority limits.

FIG. 20 shows the general process proposed by the second alternate embodiment to convert clear signal aspects 163 to corresponding movement authority limits 175. The first step is to identify the fixed detection block VTC-k where a train V-i is located 209 using physical train location Li 213 (as calculated by the independent train location determination subsystem), and the fixed detection block boundaries (stored in the data base of the MCP 150). The second step 211 is to identify the closest wayside signal VSig-k ahead of train V-i. The next step 215 is to convert the clear aspect of VSig-k into a movement authority limit MAL-i based on the control line for signal VSig-k. In the following step 217, the MCP 150 sends the movement authority limit MAL-i to the VSAP 152 in order to override the wayside signals within MAL-i, and to verify that the associated automatic stops are in the clear position. Upon receiving MAL-i, the VSAP 152 overrides 219 the appropriate wayside signals and sends the statuses of the associated automatic stops to the MCP 150. In the next step 221, the MCP 150 validates that blocks included in MAL-i are vacant. Upon confirmation that the blocks included in MAL-i are vacant, the MCP 150 sends MAL-i to V-i 222. In turn, V-i sends 224 MAL-i to associated physical train P-i.

Similar to the first alternate embodiment, the MCP 150 of the second alternate embodiment implements the added safety function of ensuring that no train is present within a fixed detection block included in a movement authority limit MAL-i 175. Although the VSAP employs vital logic, which ensures that a signal displays a clear aspect only if the associated control line is clear, under very rare conditions, one of the train detection blocks can fail to detect a train, resulting in a false clear. This could be due to a loss of shunt, equipment failure, human failure or the like.

The virtual train control system 154 performs two independent tasks to mitigate the safety risks associated with the failure to detect a train. First, the VSAP 152 continuously compares the statuses of the train detection blocks 170 received from the physical installation, with train locations received from the MCP 150. Upon the detection of a discrepancy (i.e. for example train location received from the MCP 150, falls within a train detection block with a "vacant" status), the V SAP 152 will activate the red aspect of all affected wayside signals, and will set all associated automatic stops to the tripping position. Further, the VSAP 152 will provide data to the MCP 150 indicating such discrepancy. In turn, the MCP 150 will cancel all movement authority limits impacted by the failure. Second, the MCP 150 will perform a safety check during the process to convert a clear signal aspect to movement authority limit. This safety check includes the detection of any communicating train located within the limits of a generated movement authority. Upon such detection, the MCP 150 will cancel all impacted movement authority limits, and will provide data to the VSAP 152 to activate the red aspects at all affected wayside signals.

Figure 21:
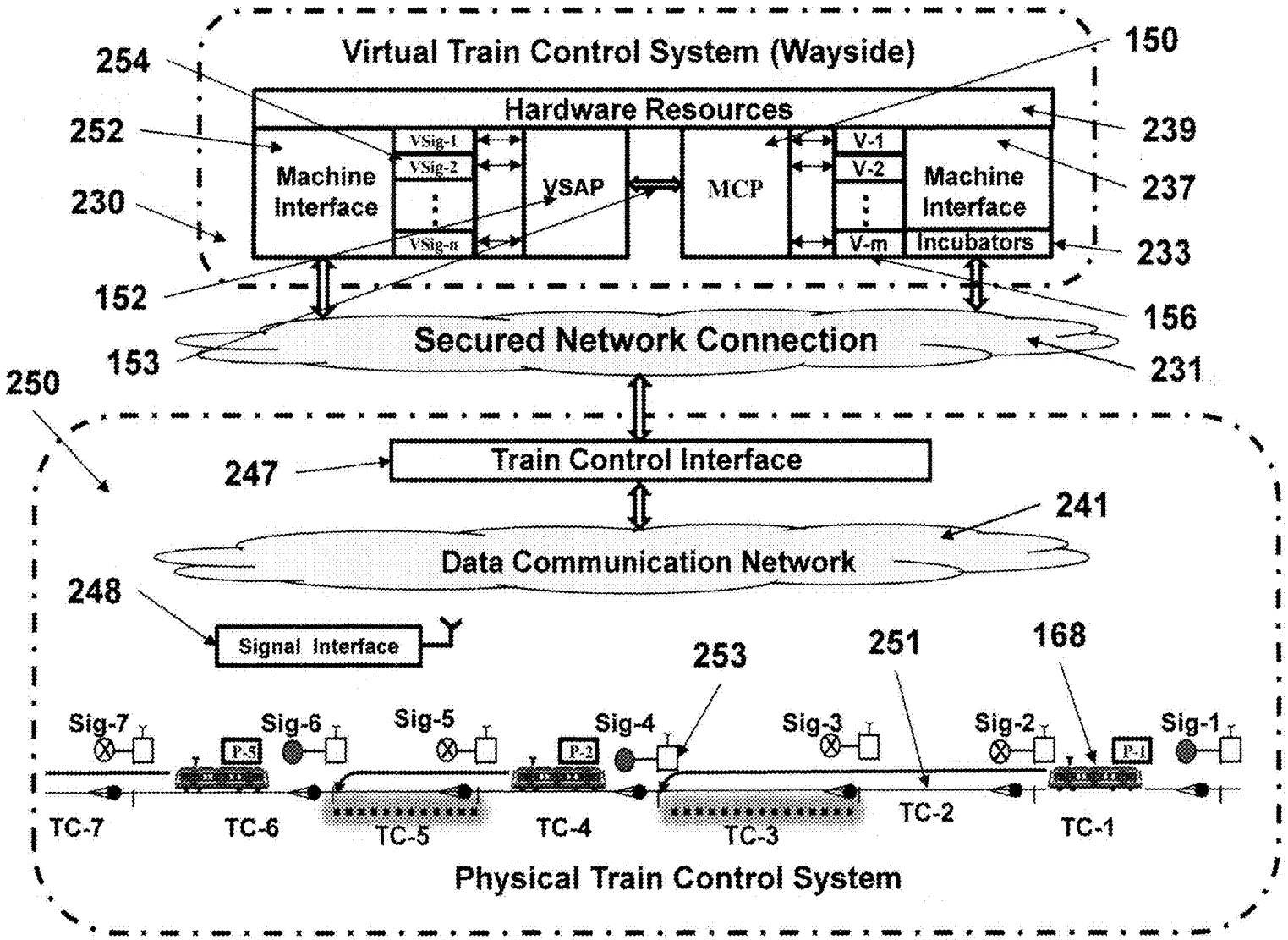
FIG. 21 shows a block diagram of an auxiliary wayside signal system that provides distance-to-go operation, indicating the physical train control elements, and the cloud computing resource elements that provide the virtual train control system that controls wayside signals, and converts signal aspects to movement authority limits.

FIG. 21 shows a block diagram of the AWS installation based on fixed block, wayside technology. The block diagram demonstrates how the AWS installation is partitioned into a physical train control installation 250 and a virtual train control system (Wayside) 230. The physical train control installation 250 includes the fixed train detection blocks 251, wayside signal equipment 253, a train control interface 247, a data communication network 241, a signal interface module 248, and onboard train control computers (for trains P-1, P-2 & P-5) 168. The virtual train control system 230 includes the hardware computing resources 239 for the various train control application platforms, including the MAL Conversion Processor (MCP application platform) 150, the virtual signal application processor (VSAP application platform) 152, and the application platform that emulates the onboard train control computers 156. Since the number of trains operating in the territory can vary, the virtual train control system provides a plurality (m) of computing modules 156 that emulate the onboard train control computers. Therefore, the maximum number of equipped trains that can operate in this section of the railroad is limited to m.

Figure 22:
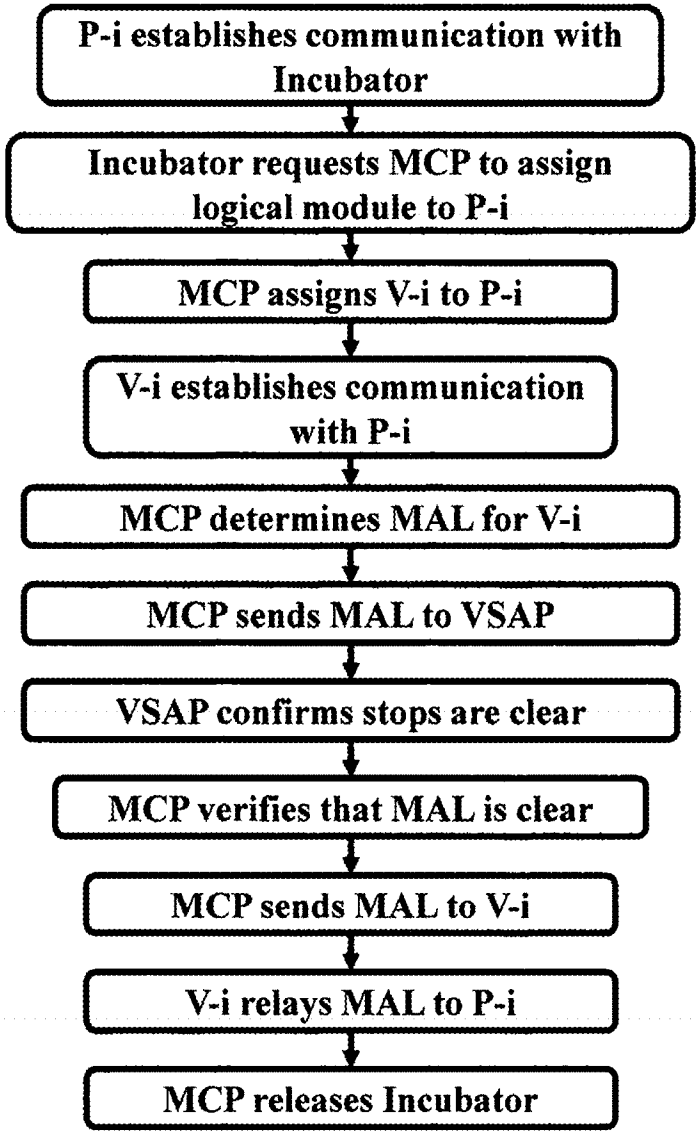
FIG. 22 shows the steps in the process to assign and initialize a virtual train for distance-to-go operation in the cloud computing environment associated with an auxiliary wayside signal system.

The virtual train control system 230 also includes a plurality of logical elements or modules 233 that act as incubators to initialize a new equipped train detected in the physical installation into the virtual train control system. This initialization process is not applicable to equipped trains moving from adjacent sections of the railroad into this section. Those trains are tracked by the system, and move from one section into an adjacent section (in both physical and virtual environments) using a transition process. Rather, the incubator process is intended to initialize a physical equipped train when it is first detected in the train control installation. As a new physical equipped train (P-i) is detected in the section, it is necessary to establish a corresponding virtual train (V-i) in the virtual train control system. For the second alternate embodiment, which implements wayside signaling technology, the detection is through radio communication. The initial frequency or radio channel assigned to the train is designed and/or configured to establish communication with one of the plurality of incubators 233. Upon establishing such communication, the incubator requests the MCP 150 to assign a virtual train to physical train P-i, and initialize the virtual train into the virtual system 230. The initialization process is coordinated with the MCP task to determine the fixed detection block VTC-k where V-i (P-i) is located 209 (FIG. 20). Upon receiving a request from the incubator, the MCP 150 assigns an available logical module (virtual train) V-i to P-i. Then upon establishing communication between P-i & V-i, the MCP 150 identifies the closest signal VSig-k ahead of train V-i. The MCP 150 then determines a movement authority limit for V-i based on the control line for signal VSig-k (or the control line for the signal ahead of VSig-k if it is displaying a "green" aspect). The MCP 150 then transmits the movement authority limit to the VSAP 152 to override signals located within the movement authority limit and verify that the associated stops are in the clear position. Upon receiving a confirmation from the VSAP 152 that the stops for overridden signals are in the clear position, the MCP 150 transmits the movement authority limit to virtual train V-i, which in turn will relay the movement authority to P-i. After the completion of this initialization process for train V-i (P-i), the MCP 150 releases the incubator 233 so that the process is repeated when a new train is detected in the railroad section. The above described initialization process is shown in FIG. 22.

Figure 23:
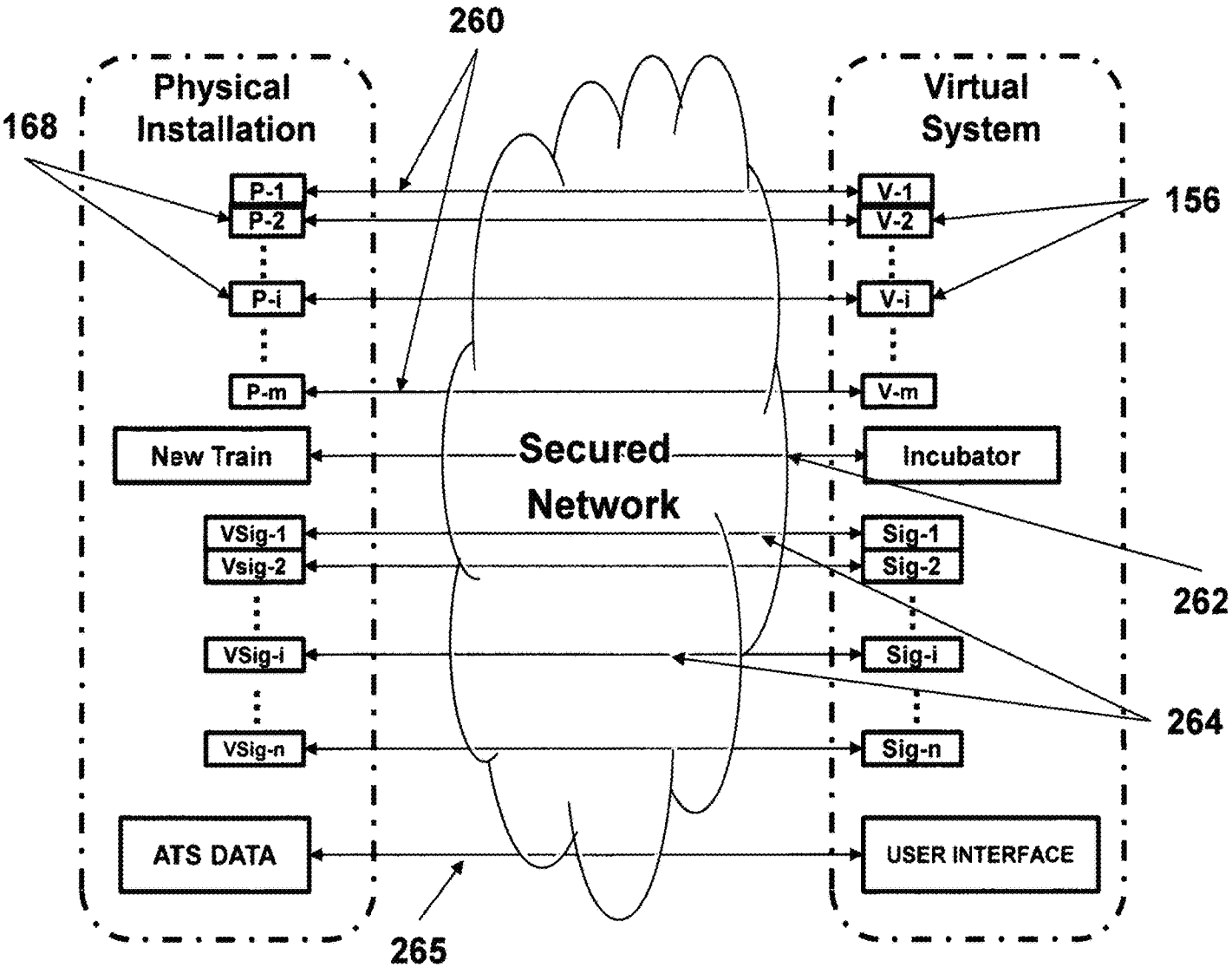
FIG. 23 shows the main communication channels required between the physical installation and the virtual train control system for an auxiliary wayside signal system that also provides distance-to-go operation.
Figure 24:
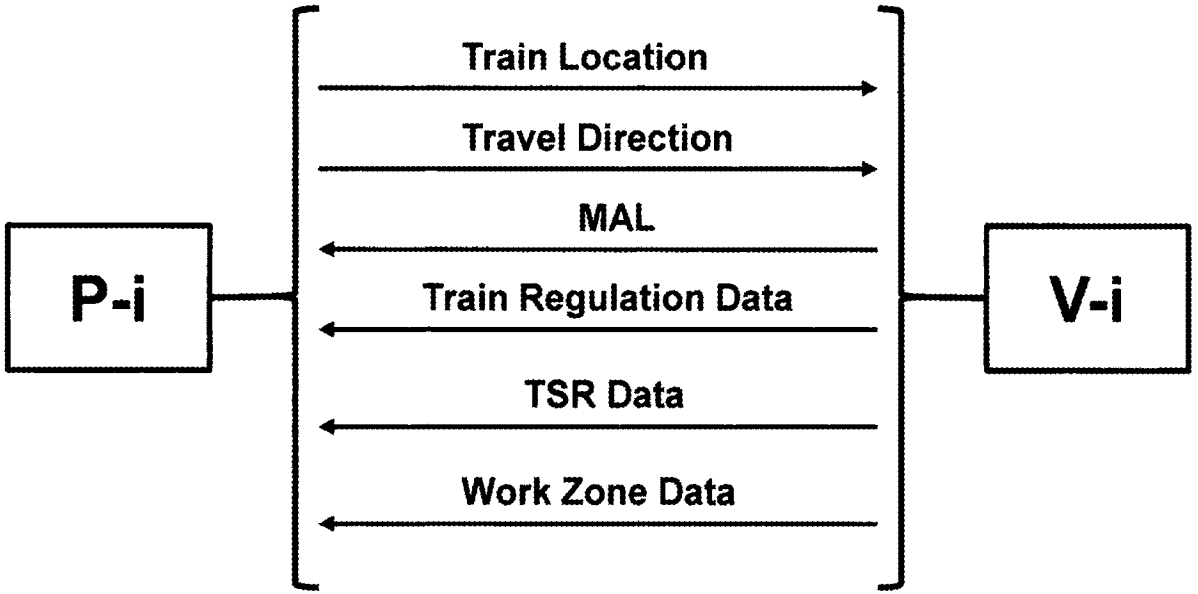
FIG. 24 shows the main data and information exchanged between a physical train controller and a corresponding logical element (virtual train) in the cloud computing environment for an auxiliary wayside signal system that also provide distance-to-go operation.
Figure 25:
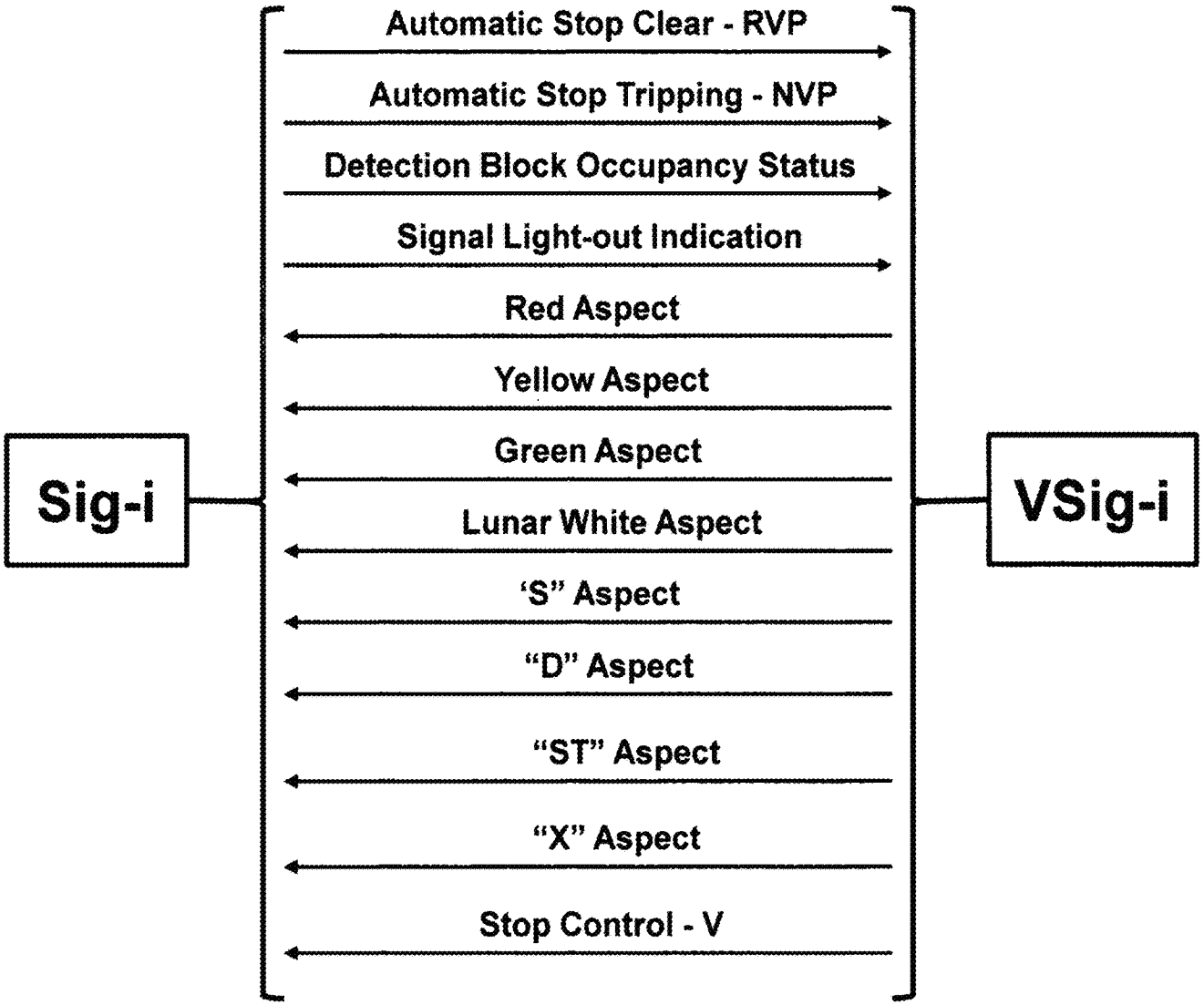
FIG. 25 shows the main data and information exchanged between a physical wayside signal location and a corresponding logical element (virtual signal location) in the cloud computing environment for an auxiliary wayside signal system.

The virtual train control system (Wayside) 230 also includes machine interfaces 237 & 252 that represent the demarcation points for communications with the physical train control installation 250 through a secure network connection 231. In that respect, FIG. 23 shows the main communication channels between the physical installation and the virtual train control systems for an auxiliary wayside signal implementation as per the second alternate embodiment. In general, two way communications 260 is required between physical trains 168 and virtual (logical) trains 156, between new detected trains and incubators 262, between physical and virtual (logical) signal locations 264, and between the ATS of the physical installation and the user interface at the virtual train control system 265. FIG. 24 shows the various status information and control data exchanged between physical train P-i and corresponding virtual train V-i. Similarly, FIG. 25 shows the various status information and control data exchanged between a physical signal location Sig-i and the associated virtual signal location VSig-i. It should be noted that the specific status information and control data shown in FIG. 24 are set forth for the purpose of describing second alternate embodiment, and are not intended to limit the invention hereto. As would be understood by a person of ordinary skills in the art, additional or different status information and control data may be exchanged between a physical train and a corresponding virtual (logical) train depending on the requirements and design for the auxiliary wayside signal system.

The VSAP application platform 152 could be based on interlocking rules approach or could employ Boolean equations to implement control logic for the wayside signal locations. In addition, the VSAP application platform could be centralized or could be distributed of the architecture type described in U.S. Pat. No. 8,214,092. Further, the specific trackside signal equipment can vary from system to system and from location to location. For example, a fixed train detection block could be implemented using track circuits or axle counters. Also, an automatic train stop could be of the mechanical type or the magnetic type. As such, the specific status information and control data exchanged between each physical signal location and the corresponding virtual signal location (FIG. 25) will vary from installation to installation All such variations described above are within the scope of this invention. With respect to the interfaces 153 between the VSAP 152 and the MCP 150, the VSAP provides the MCP with the status of signal equipment, including positions of automatic train stops, signal aspects, statuses of fixed train detection blocks, and results of process that compares statuses of fixed train detection blocks with train locations. Similarly, the MCP provides the VSAP with train locations, movement authority limits, and the results of the process to check if a train is located within a block included in a movement authority limit. In addition, as shown in FIG. 23, the MCP receives data related to temporary speed restrictions and work zones from a user interface that communicates with an ATS subsystem 265.

With respect to the main operation of the auxiliary wayside signal installation described in FIGS. 17, 18 & 21, there are three different types of operation provided by this installation. The first type of operation occurs in the absence of equipped trains. Under such operating scenario, the unequipped trains operate manually under the protection of the wayside signals. Train detection is provided by the fixed train detection blocks, and train separation is based on the control lines of the wayside signals. The second type of operation occurs when equipped trains operate on the line. Each physical train P-i 168 determines its own location using an independent location determination subsystem, and then transmits its location to the corresponding virtual train V-i 156 in the virtual train control system. In turn, each virtual train V-i 156 communicates its location to the MCP 150. Using a data base that stores data related to the fixed train detection blocks, the MCP 150 identifies the closest virtual signal ahead of the virtual train, and converts its clear aspect into corresponding movement authority limit based on its control line. The MCP 150 then communicates the movement authority limit to the VSAP 152 to override wayside signals located within the movement authority limit. In turn, the VSAP 152 confirms to the MCP 150 that these signals have been overridden, and that their automatic stops are in the clear position. The MCP 150 then verifies that the fixed train detection blocks included in the movement authority limit are vacant, and communicates the calculated movement authority limits to the virtual train 156. Each virtual train 156 then sends the received movement authority limit to the corresponding physical train 168. Upon receiving a movement authority limit, a physical train P-i generates a stopping profile from its current location to the end of the received movement authority limit, using track topography data stored in its vital on-board data base, and taking into account any civil speed limits reflected in the data base. The onboard computer then ensures that the physical train does not exceed the speed and the movement authority limit defined by the stopping profile. As the physical trains move on the track, they update their locations to the corresponding virtual trains, which report their updated information to the MCP 150. In turn the MCP updates the movement authority limits for the various trains operating on the system as they approach the next wayside signals, and the cycle repeats. The third type of operation occurs when a mixed fleet of equipped and unequipped trains operate on the line. Under such condition, unequipped trains operate under the protection of the wayside signal installation, while equipped trains operate under the protection of the on-board equipment based on movement authority limits generated by the MCP in the virtual train control system. When an equipped train follows an unequipped train, its movement authority ends at the boundary of the block where the unequipped train is located (i.e. no overlap block is maintained). Conversely, when an unequipped train follows an equipped train, the train is stopped at the closest red signal (closest to the unequipped train) behind the equipped train such that at least one overlap block is maintained as a buffer between the two trains.

Similar to the preferred embodiment, and the first alternate embodiment, the logical modules (virtual trains) could be used to implement additional train control functions that can be exercised for a particular train or a group of trains if service conditions require it. The logical modules can also implement temporary train control functions that could limit the functions available onboard specific trains.

With respect to failure modes management for the second alternate embodiment, the proposed architecture has the advantage of providing an almost fault free cloud computing environment for the application platforms required for an auxiliary wayside signal system, including the application to convert manual operation into a distance-to-go operation. As such, a total failure of a MAL Conversion Processor or a virtual signal application processor is very unlikely. Potential failures of the installation include a loss of communication between a physical train and a virtual train, a loss of communication between physical wayside signal and corresponding virtual signal, or a total loss of communication within a section of the railroad.

If a physical train loses communication with its corresponding virtual train, the physical train can be operated in manual mode using wayside signal aspects. In such a case, the affected train will lose the ability to close in on a train ahead, but the train will continue to operate with signal protection. The corresponding virtual train will lose its movement authority limit, and its location will not be updated via information received from the corresponding physical train. However, the MCP can still track the physical train movement based on occupancy information provided by the VSAP. It should be noted that when a virtual train loses communication with a physical train, it remains assigned to the physical train until communication is re-established, or the virtual train is released for reassignment by the system administrator (case when the physical train is taken out of service or leaves the section of the railroad).

If communication is lost between a physical signal location and its associated virtual signal location, the physical signal will display a red ("stop") aspect, and its corresponding stop will be in the tripping position. All trains (equipped and unequipped) will operate in a manual mode in the approach to the failed signal, and will be able to "key-by" the signal pursuant to operating rules and procedures. The "key-by" function is well known in the art, and is programmed locally in the processor 210 at each physical location (FIG. 19). Within the virtual train control system, the failed signal location will display a red aspect, and a virtual train can move past the failed signal location only if the corresponding physical train is able to key-by the physical signal. Further, since the loss of communication between a physical signal location and the corresponding virtual signal location results in an unknown status for the train detection block associated with the failed signal location, the VSAP assumes that said train detection block is occupied, and all affected signals will display a "red" aspect.

In the unlikely event of a total loss of communications between the physical train control installation and the virtual train control system, all affected physical trains will operate in manual mode. Also, all affected wayside signal locations will display a "stop" aspect. In the virtual system, all affected virtual trains will lose their movement authority limits, and all affected virtual signal locations will display a stop aspect. All physical trains will operate passed wayside signals using the "key-by" function. Upon reestablishing communications, the system and all virtual trains operating in the section need to be initialized before the AWS system can resume normal operation.

As would be understood by those skilled in the art, different alternate embodiments can be provided to implement an auxiliary signal system based on wayside signaling technology. For example, the MCP and the VSAP could be combined into a single application platform. Also, alternate cloud computing architecture could be used to implement the virtual train control system. Further, a different communications configuration could be used to exchange status information and control data between the elements of the physical installation and the corresponding elements of the virtual train control system. It is also to be understood that the foregoing detailed description of the second alternate embodiment has been given for clearness of understanding only, and is intended to be exemplary of the invention while not limiting the invention to the exact embodiments shown.

Figure 26:
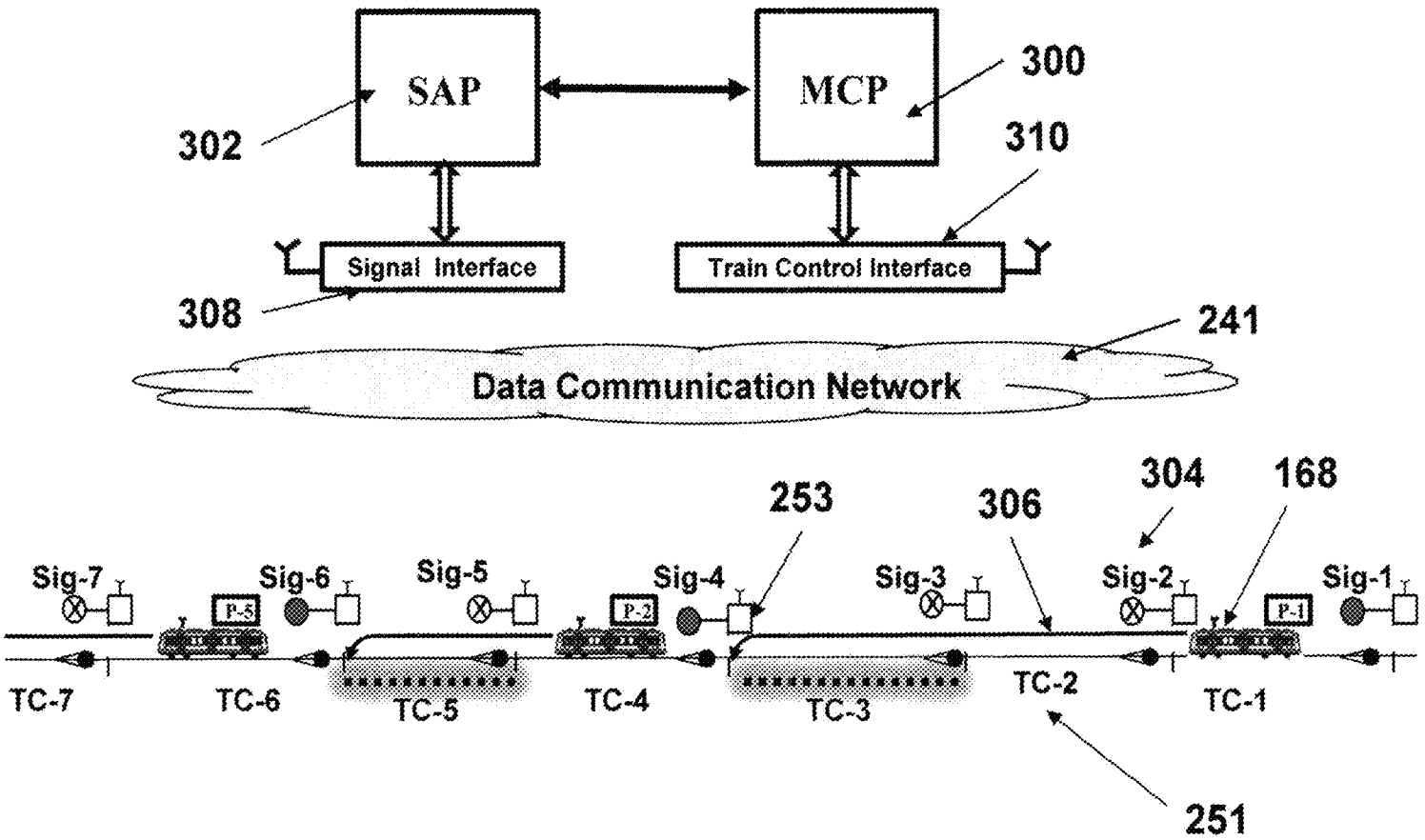
FIG. 26 shows a block diagram for a physical train control installation based on fixed block, wayside signaling technology, and with implements the concept of converting wayside signal aspects to corresponding movement authority limits in order to provide distance-to-go operation in accordance with one aspect of the invention.

It should be noted that the disclosed new process (apparatus and method) to convert manual operation based on fixed block wayside signaling into a distance-to-go operation can be implemented without the use of cloud computing environment and virtualization. As shown in FIG. 26, a MAL Conversion Processor (MCP) 300 and a Signal Application Processor (SAP) 302 are used in a physical installation to convert the clear aspects at wayside signal locations 304 into movement authority limits 306. In the shown architecture, the SAP 302 receives the statuses of the wayside signal equipment from a signal interface device 308, which in turn communicates with wayside signal locations 253 via a wireless data communication network 241. The SAP 302 processes the statuses information, and generates control data for the wayside signal equipment. The control data is transmitted to the wayside signal locations 253 via the wireless data communication network 241.

Similarly, the MCP 300 communicates with the various trains 168 through the train control interface 310 and the wireless data communication network 241. As described above in details, the MCP receives train location information and employs a database that includes information related to train detection block boundaries and the location of wayside equipment. The MCP then determines the train detection block where a train is located and the closest signal location ahead of the train. Using signal status information received from the SAP 302, the MCP 300 converts a clear signal aspect into a corresponding movement authority limit. As described above, the MCP 300 sends the calculated MAL to the SAP 302 to override signals within the limits of the movement authority, and confirm that the associated automatic stops are in the clear position. The MCP 300 then verifies that train detection blocks included in the MAL are clear before sending the MAL to the train 168. As described above, the controller onboard the train uses the MAL to generate a stopping profile that governs the movement of the train from its current location to the end of its movement authority limit.

As disclosed above in the preferred embodiment, the first alternate embodiment and the second alternate embodiment, the cloud computing environment and the virtualization process could be used to control signal and train control installations based on various technologies, including communications based train control, cab-signaling and fixed block, wayside signal technology. Further, the above disclosure describes the techniques that can be used to convert cab-signaling operation and manual operation based on fixed block, wayside signaling into distance-to-go type operation that is compatible with CBTC operation. The use of these techniques in combination with cloud computing environment and virtualization enables a railroad or a transit property to achieve interoperability between sections of the railroad that employ different signaling and train control technologies.

It should be noted that the processes disclosed in the various embodiments can utilize alternate vital programs to implement the described train control functions. Obviously these programs will vary from one another in some degree. However, it is well within the skill of the signal engineer to provide particular programs for implementing vital algorithms to achieve the functions described herein. It is also to be understood that the foregoing detailed description has been given for clearness of understanding only, and is intended to be exemplary of the invention while not limiting the invention to the exact embodiments shown. Obviously certain subsets, modifications, simplifications, variations and improvements will occur to those skilled in the art upon reading the foregoing. It is, therefore, to be understood that all such modifications, simplifications, variations and improvements have been deleted herein for the sake of conciseness and readability, but are properly within the scope and spirit of the following claims.

The invention claimed is:

1. A train control system comprising:

a physical train control installation that is located at a user's property, and which includes a plurality of physical train control elements, wherein said plurality of physical train control elements generates operating data, a virtual train control system implemented in cloud computing environment that includes at least one processor that performs train control functions and at least one interface module to interface the at least one processor with said plurality of physical train control elements, wherein the virtual train control system is under the jurisdiction of a supplier and provides a train control service to the user, wherein the virtual train control system receives operating data from the physical train control installation, and wherein said service includes transmitting to the user control data to control physical train control elements, and a communication network that interconnects the virtual train control system and the physical train control installation.

2. A train control system as recited in claim 1, wherein the physical train control elements include control modules located onboard physical trains, and wherein an on-board control module controls the movement of an associated physical train and provides at least the function of overspeed protection.

3. A train control system as recited in claim 1, wherein said physical train control elements include at least one of a train detection block, a wayside signal, an automatic train stop and a switch machine.

4. A train control system as recited in claim 1, wherein said physical train control elements includes cab-signaling blocks.

5. A train control system as recited in claim 2, wherein said control data to control the physical train control elements include at least one of speed codes temporary speed limits, work zone data and movement authority limits.

6. A train control system as recited in claim 3, wherein said control data to control the physical train control elements include at least one of control data to activate a wayside signal, control data to activate an automatic train stop and control data to operate a switch machine.

7. A train control system as recited in claim 2, wherein said operating data includes locations of physical trains.

8. A train control system as recited in claim 3, wherein said operating data includes at least one of status of train detection device, status of wayside signal, status of automatic train stop and position of track switch.

9. A train control system comprising:

a physical train control installation that includes a plurality of physical signal equipment that generates operating data, and wherein said signal equipment includes at least one of wayside signal, automatic train stop and switch machine, a virtual train control system implemented in cloud computing environment that includes at least one processor that performs train control functions and at least one interface module to interface the at least one processor with said plurality of physical signal equipment, wherein the virtual train control system receives operating data from the physical train control installation, and wherein the virtual train control system transmits control data to the physical train control installation to control the physical signal equipment, and a communication network that interconnects the virtual train control system and the physical train control installation.

10. A train control system as recited in claim 9, further comprising an interface to an automatic train supervision system.

11. A train control system as recited in claim 9, wherein the physical train control installation is located at a rail or transit property, wherein the virtual train control system is under the jurisdiction of a supplier and wherein said control data is provided as a service to said rail or transit property.

12. A train control system comprising:

a physical train control installation that includes a plurality of train control modules located on-board physical trains, wherein a physical train control module controls the operation of an associated physical train and provides data related to the operation of an associated physical train, a virtual train control installation implemented in cloud computing environment that includes at least one processor that performs train control functions and at least one interface module to interface the at least one processor with said plurality of train control modules, wherein the virtual train control installation receives data messages from train control modules related to associated physical trains, and wherein the virtual train control installation transmits control data to said train control modules, and a communication network that interconnects the virtual train control installation and the physical train control installation.

13. A train control system as recited in claim 12, wherein an on-board train control module transmits the location of an associated physical train to the virtual train control installation.

14. A train control system as recited in claim 12, further comprising an interface to an automatic train supervision system.

15. A train control system as recited in claim 12, wherein the virtual train control installation generates control data that includes at least one of speed codes, temporary speed limits, data for work zones and movement authority limits that are transmitted to the train control modules located on-board physical trains.

16. A train control system as recited in claim 12, wherein the physical train control installation is located at a user's property, wherein the virtual train control installation is under the jurisdiction of a supplier and wherein said control data is provided as a service to the user.

17. A method for a train control system, wherein a train control installation is configured into two main parts, wherein the first part includes physical wayside signal equipment, wherein the wayside signal equipment includes at least one of wayside signals, automatic train stops, cab-signaling blocks, train detection devices and switch machines, wherein the second part is implemented in a cloud computing environment, and includes processing resources, which implement signal application platform that provides signal control logic, and wherein a data communication structure provides two-way communications between said two main parts, comprising the following steps:

determining status of wayside signal equipment in the first part, transmitting said status of wayside signal equipment from the first part to the second part, generating control data for wayside signal equipment at said signal application platform, and transmitting said control data for wayside signal equipment to the first part.

18. A method for a train control system as recited in claim 17, wherein said first part is located at a transit or rail property, wherein said second part is under the jurisdiction of a train control supplier, and wherein said control data for wayside signal equipment is provided as a service to the transit or rail property.

19. A method for a train control system, wherein the train control system is configured into two main parts, wherein the first part includes a physical installation of train control equipment, wherein the second part is implemented in a cloud computing environment, and includes processing resources, which implement a virtualization of a train control application to control the physical installation, and wherein a data communication network provides two-way communications between said two main parts, comprising the following steps:

generating data messages related to the operation of physical train control equipment in the first part, transmitting said data messages from the first part to the second part, generating control data for physical train control equipment in the second part, and transmitting said control data for physical train control equipment to the first part.

20. A method for a train control system as recited in claim 19, wherein the physical installation includes train control modules on board physical trains, and wherein said control data includes at least one of temporary speed restrictions and data for work zones.

21. A method for a train control system as recited in claim 19, wherein the physical installation includes track switch machines, and wherein said control data includes commands to control the operation of said switch machines.

22. A train control system comprising:

a physical train control installation that includes physical train control elements, and provides data related to the operation of said physical train control elements, a virtual train control system implemented in cloud computing environment that includes at least one processor that implements a virtualization of a train control application to provide train control functions, at least one interface module to interface the at least one processor with said physical train control elements, wherein the virtual train control system receives said data related to the physical train control elements from the physical train control installation, and transmits control data to the physical train control installation to control physical train control elements, and a communication network that interconnects the virtual train control system and the physical train control installation.

23. A train control system as recited in claim 22, wherein the physical train control elements include at least one of a wayside signal and a switch machine.

24. A train control system as recited in claim 23, wherein the operating data includes switch position and wherein the control data controls the movement of the switch machine.

25. A train control system as recited in claim 22, wherein the physical train control elements include control module on-board physical trains.

26. A train control system as recited in claim 25, wherein the control data transmitted from the virtual train control system to the physical train control installation includes at least one of speed codes, movement authority limits, temporary speed restrictions and data for work zones.

* * * * *